US010519394B2

(12) United States Patent
Dance et al.

(10) Patent No.: US 10,519,394 B2
(45) Date of Patent: Dec. 31, 2019

(54) METHOD FOR PREVENTING OR REDUCING LOW SPEED PRE-IGNITION WHILE MAINTAINING OR IMPROVING CLEANLINESS

(71) Applicant: ExxonMobil Research and Engineering Company, Annandale, NJ (US)

(72) Inventors: Smruti A. Dance, Robbinsville, NJ (US); Douglas E. Deckman, Mullica Hill, NJ (US); Raymond G. Burns, III, Aston, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 72 days.

(21) Appl. No.: 15/807,946

(22) Filed: Nov. 9, 2017

(65) Prior Publication Data

US 2018/0066203 A1 Mar. 8, 2018

Related U.S. Application Data

(63) Continuation-in-part of application No. 14/706,190, filed on May 7, 2015, now abandoned.
(Continued)

(51) Int. Cl.
*C10M 169/04* (2006.01)
*C10M 133/44* (2006.01)
(Continued)

(52) U.S. Cl.
CPC ..... *C10M 133/44* (2013.01); *C10M 129/54* (2013.01); *C10M 133/58* (2013.01);
(Continued)

(58) Field of Classification Search
CPC ..... C10M 129/10; C10M 129/56; C10M 131/12; C10M 133/16; C10M 137/02;
(Continued)

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 A 1/1981
EP 471071 B1 2/1991
(Continued)

OTHER PUBLICATIONS

The International Search Report and Written Opinion of PCT/US2017/060982 dated Jul. 11, 2018.
(Continued)

*Primary Examiner* — Taiwo Oladapo
(74) *Attorney, Agent, or Firm* — Robert A. Migliorini

(57) ABSTRACT

A method for preventing or reducing low speed pre-ignition in an engine lubricated with a lubricating oil while maintaining or improving cleanliness by using as the lubricating oil a formulated oil. The formulated oil has a composition including a lubricating oil base stock as a major component, and at least one boron-containing compound and at least one overbased calcium detergent as minor components. The at least one boron-containing compound includes at least one borated dispersant, or a mixture of a boron-containing compound and a non-borated dispersant. The boron to nitrogen ratio for the at least one boron-containing compound is less than or equal to about 0.3 and the lubricating oil is essentially free of elemental magnesium. The lubricating oils of this disclosure are particularly advantageous as passenger vehicle engine oil (PVEO) products.

27 Claims, 44 Drawing Sheets

| | Example 1 | Comparative Example 1 | Comparative Example 2 | Example 2 | Comparative Example 5 | Example 11 |
|---|---|---|---|---|---|---|
| Group III 1, wt% | 48.84 | 48.84 | 48.84 | 48.84 | 48.84 | 48.84 |
| Group IV 1, wt % | 23.62 | 21.69 | 23.34 | 25.767 | 27.59 | 15.867 |
| Group V 1, wt% | 5 | 5 | 5 | 5 | 5 | 5 |
| Viscosity Index Improver | 2 | 3 | 3 | 2 | 2 | 2 |
| Borated Succinimide Dispersant, wt % | 2.77 | | | 5.823 | | 5.823 |
| High MW Succinimide Dispersant 1, wt % | 5.2 | 9.9 | | | | 9.9 |
| High MW Succinimide Dispersant 2, wt % | | | 8.25 | | | |
| Rest of formulation, wt % | 12.57 | 12.57 | 12.57 | 12.57 | 12.57 | 12.57 |
| | | | | | | |
| Sulfated Ash, wt % | 1.2 | 1.2 | 1.2 | 1.2 | 1.2 | 1.2 |
| Dispersant Nitrogen, ppm | 990 | 990 | 990 | 990 | 0 | 1980 |
| Boron, ppm | 241 | 0 | 0 | 507 | 0 | 507 |
| **Normalized LSPI Counts per 25,000 Engine Cycles** | **27** | **46** | **43** | **24** | **22** | **36** |

Related U.S. Application Data

(60) Provisional application No. 61/990,764, filed on May 9, 2014.

(51) Int. Cl.

| | |
|---|---|
| ***C10M 129/54*** | (2006.01) |
| ***C10M 135/10*** | (2006.01) |
| ***C10M 137/10*** | (2006.01) |
| ***F01M 9/02*** | (2006.01) |
| ***C10M 133/58*** | (2006.01) |

(52) U.S. Cl.

CPC ..... *C10M 135/10* (2013.01); *C10M 137/10* (2013.01); *C10M 169/04* (2013.01); *F01M 9/02* (2013.01); *C10M 2207/144* (2013.01); *C10M 2215/223* (2013.01); *C10M 2215/30* (2013.01); *C10M 2219/044* (2013.01); *C10M 2223/045* (2013.01); *C10N 2230/04* (2013.01); *C10N 2230/45* (2013.01); *C10N 2230/52* (2013.01); *C10N 2240/104* (2013.01)

(58) Field of Classification Search

CPC ..... C10M 137/06; C10M 163/00; C10M 2201/085; C10M 2203/1006; C10M 203/1025; C10M 2205/0285; C10M 2207/028; C10M 2207/122; C10M 2207/123; C10M 2207/146; C10M 2207/16; C10M 2207/262; C10M 2215/28; C10M 2217/043; C10M 2219/046; C10M 2223/045; C10N 2210/02; C10N 2230/45; C10N 2230/52; C10N 2240/10; C10N 2240/104; C10N 2260/14

See application file for complete search history.

(56) References Cited

U.S. PATENT DOCUMENTS 2,191,498 A 2/1940 Reiff
2,387,501 A 10/1945 Dietrich
2,655,479 A 10/1953 Munday et al.
2,666,746 A 1/1954 Munday et al.
2,721,877 A 10/1955 Popkin et al.
2,721,878 A 10/1955 Popkin
2,817,693 A 12/1957 Koome et al.
3,036,003 A 5/1962 Verdol
3,087,936 A * 4/1963 Le Suer ..... C07C 243/00 548/405
3,172,892 A 3/1965 Le Suer et al.
3,200,107 A 8/1965 Le Suer
3,215,707 A 11/1965 Rense
3,219,666 A 11/1965 Norman et al.
3,235,494 A 2/1966 Piatt et al.
3,250,715 A 5/1966 Wyman
3,254,025 A 5/1966 Le Suer
3,272,746 A 9/1966 Le Suer et al.
3,275,554 A 9/1966 Wagenaar
3,316,177 A 4/1967 Dorer, Jr.
3,322,670 A 5/1967 Hammond et al.
3,329,658 A 7/1967 Fields
3,341,542 A 9/1967 Le Suer et al.
3,382,291 A 5/1968 Brennan
3,413,347 A 11/1968 Worrel
3,438,757 A 4/1969 Honnen et al.
3,444,170 A 5/1969 Norman et al.
3,449,250 A 6/1969 Fields
3,454,555 A 7/1969 van der Voort et al.
3,454,607 A 7/1969 Le Suer et al.
3,519,565 A 7/1970 Coleman
3,541,012 A 11/1970 Stuebe
3,565,804 A 2/1971 Honnen et al.
3,595,791 A 7/1971 Cohen
3,630,904 A 12/1971 Musser et al.
3,632,511 A 1/1972 Liao
3,652,616 A 3/1972 Watson et al.
3,666,730 A 5/1972 Coleman
3,687,849 A 8/1972 Abbott
3,697,574 A 10/1972 Piasek et al.
3,702,300 A 11/1972 Coleman
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,742,082 A 6/1973 Brennan
3,751,365 A 8/1973 Piasek et al.
3,755,433 A 8/1973 Miller et al.
3,756,953 A 9/1973 Piasek et al.
3,769,363 A 10/1973 Brennan
3,787,374 A 1/1974 Adams
3,798,165 A 3/1974 Piasek et al.
3,803,039 A 4/1974 Piasek et al.
3,822,209 A 7/1974 Knapp et al.
3,830,723 A 8/1974 Ladeur et al.
3,876,720 A 4/1975 Heilman et al.
3,948,800 A 4/1976 Meinhardt
4,100,082 A 7/1978 Clason et al.
4,149,178 A 4/1979 Estes
4,218,330 A 8/1980 Shubkin
4,234,435 A 11/1980 Meinhardt et al.
4,239,930 A 12/1980 Allphin et al.
4,367,352 A 1/1983 Watts, Jr. et al.
4,413,156 A 11/1983 Watts, Jr. et al.
4,426,305 A 1/1984 Malec
4,434,408 A 2/1984 Baba et al.
4,454,059 A 6/1984 Pindar et al.
4,594,172 A 6/1986 Sie
4,767,551 A 8/1988 Hunt et al.
4,798,684 A 1/1989 Salomon
4,827,064 A 5/1989 Wu
4,827,073 A 5/1989 Wu
4,897,178 A 1/1990 Best et al.
4,910,355 A 3/1990 Shubkin et al.
4,921,594 A 5/1990 Miller
4,941,984 A 7/1990 Chamberlin, III et al.
4,943,672 A 7/1990 Hamner
4,956,122 A 9/1990 Watts et al.
4,975,177 A 12/1990 Garwood et al.
5,068,487 A 11/1991 Theriot
5,075,269 A 12/1991 Degnan et al.
5,084,197 A 1/1992 Galic et al.
5,705,458 A 1/1998 Roby et al.
6,034,039 A 3/2000 Gomes et al.
6,080,301 A 6/2000 Berlowitz et al.
6,090,989 A 7/2000 Trewella et al.
6,165,949 A 12/2000 Berlowitz et al.
6,846,782 B2 * 1/2005 Calder ..... C10M 111/02 508/293
7,704,930 B2 4/2010 Deckman et al.
3,048,833 A1 11/2011 Habeeb et al.
2001/0036906 A1 7/2002 Locke et al.
2008/0128184 A1 6/2008 Loper et al.
2009/0082233 A1 3/2009 Kasai
2009/0163393 A1 * 6/2009 Boffa ..... C10M 111/02 508/496
2009/0308070 A1 12/2009 Alger, II et al.
2011/0160108 A1 * 6/2011 Cook ..... C10M 159/24 508/391
2011/0265761 A1 * 11/2011 Amann ..... F02D 35/027 123/406.11
2012/0186225 A1 * 7/2012 Amann ..... F02D 35/028 60/274
2015/0307802 A1 10/2015 Ritchie et al.
2016/0222314 A1 8/2016 Mosier et al.
2016/0230115 A1 8/2016 Mosier et al.
2016/0230116 A1 8/2016 Mosier et al.

(56) References Cited

U.S. PATENT DOCUMENTS

| | | | |
|---|---|---|---|
| 2016/0272915 | A1 | 9/2016 | Mosier et al. |
| 2017/0022441 | A1 | 1/2017 | Onodera et al. |
| 2018/0087001 | A1 | 3/2018 | Mosier et al. |
| 2018/0346843 | A1 | 12/2018 | Mosier et al. |
| 2019/0048282 | A1 | 2/2019 | Gieselman et al. |

FOREIGN PATENT DOCUMENTS

| | | | |
|---|---|---|---|
| EP | 464546 | A1 | 1/1992 |
| EP | 464547 | A1 | 1/1992 |
| GB | 818789 | A | 8/1959 |
| GB | 1350257 | A | 4/1974 |
| GB | 1390359 | A | 4/1975 |
| GB | 1440230 | A | 6/1976 |
| JP | H09512584 | A | 4/1995 |
| JP | 2013-199595 | A | 10/2013 |
| JP | 2014152301 | A | 8/2014 |
| WO | 9529976 | A1 | 11/1995 |
| WO | 2006126651 | A1 | 11/2006 |
| WO | 2015042340 | A1 | 3/2015 |
| WO | 2015042341 | A1 | 3/2015 |

OTHER PUBLICATIONS

The International Search Report and Written Opinion of PCT/US2015/029823 dated Jul. 31, 2015.

The International Search Report and Written Opinion of PCT/US2015/029820 dated Aug. 7, 2015.

The International Search Report and Written Opinion of PCT/US2015/029825 dated Aug. 7, 2015.

Wilson, J.V.D., et al., "Lubricant Ash Content and Surface Ignition in Gasoline Engines," SAE Technical Papers, 1972, Detroit, Michigan.

Guibet, J.C., et al., "New Aspects of Preignition in European Automotive Engines," SAE Technical Papers, 1972, Detroit, Michigan.

Zahdeh, et al., "Fundamental Approach to Investigate Pre-Ignition in Boosted SI Engines," SAE International Journal of Engines, 2011, vol. 4, No. 1, pp. 246-273.

Takeuchi, et al., "Investigation of Engine Oil Effect on Abnormal Combustion in Turbocharged Direct Injection—Spark Ignition Engines," SAE International Journal of Fuels and Lubricants, 2012, vol. 5, No. 3, pp. 1017-1024.

Office Action Summary for Japanese Patent Application No. 2017-511549 dated Oct. 9, 2019.

* cited by examiner

Fig. 1

| | Example 1 | Comparative Example 1 | Comparative Example 2 | Example 2 | Comparative Example 5 | Example 11 |
|---|---|---|---|---|---|---|
| Group III 1, wt% | 48.84 | 48.84 | 48.84 | 48.84 | 48.84 | 48.84 |
| Group IV 1, wt % | 23.62 | 21.69 | 23.34 | 25.767 | 27.59 | 15.867 |
| Group V 1, wt% | 5 | 5 | 5 | 5 | 5 | 5 |
| Viscosity Index Improver | 2 | 2 | 2 | 2 | 6 | 2 |
| Borated Succinimide Dispersant, wt % | 2.77 | | | 5.823 | | 5.823 |
| High MW Succinimide Dispersant 1, wt % | 5.2 | 9.9 | | | | 9.9 |
| High MW Succinimide Dispersant 2, wt % | | | 8.25 | | | |
| Rest of formulation, wt % | 12.57 | 12.57 | 12.57 | 12.57 | 12.57 | 12.57 |
| | | | | | | |
| Sulfated Ash, wt % | 1.2 | 1.2 | 1.2 | 1.2 | 1.2 | 1.2 |
| Dispersant Nitrogen, ppm | 990 | 990 | 990 | 990 | 0 | 1980 |
| Boron, ppm | 241 | 0 | 0 | 507 | 0 | 507 |
| **Normalized LSPI Counts per 25,000 Engine Cycles** | **27** | **46** | **43** | **24** | **22** | **36** |

Fig. 3

| | Example 1 | Example 3 | Example 4 | Example 5 | Comparitive Example 1 |
|---|---|---|---|---|---|
| Group III 1, wt% | 48.84 | 48.84 | 48.84 | 48.84 | 48.84 |
| Group IV 1, wt % | 23.62 | 25.37 | 27.62 | 25.62 | 21.69 |
| Group V 1, wt% | 5 | 5 | 5 | 5 | 5 |
| Viscosity Index Improver | 2 | 2 | 2 | 2 | 2 |
| Calcium Salicylate 1, wt % | 3.5 | | | | 3.5 |
| Calcium Salicylate 2, wt % | 2 | | | | 2 |
| Calcium Sulfonate 1, wt % | | 2.45 | | | |
| Calcium Sulfonate 2, wt % | | 1.3 | | | |
| Magnesium Sulfonate, wt % | | | 1.5 | 3.5 | |
| Borated Succinimide Dispersant, wt % | 2.77 | 2.77 | 2.77 | 2.77 | |
| High MW Succinimide Dispersant 2, wt % | 5.2 | 5.2 | 5.2 | 5.2 | 9.9 |
| High MW Succinimide Dispersant 1, wt % | | | | | |
| Rest of formulation, wt % | 7.07 | 7.07 | 7.07 | 7.07 | 7.07 |

Fig. 3 (Cont.)

| | Comparitive Example 2 | Example 2 | Comparitive Example 5 | Example 11 |
|---|---|---|---|---|
| Group III 1, wt% | 48.84 | 48.84 | 48.84 | 48.84 |
| Group IV 1, wt % | 23.34 | 25.767 | 27.59 | 15.867 |
| Group V 1, wt% | 5 | 5 | 5 | 5 |
| Viscosity Index Improver | 2 | 2 | 6 | 2 |
| Calcium Salicylate 1, wt % | 3.5 | 3.5 | 3.5 | 3.5 |
| Calcium Salicylate 2, wt % | 2 | 2 | 2 | 2 |
| Calcium Sulfonate 1, wt % | | | | |
| Calcium Sulfonate 2, wt % | | | | |
| Magnesium Sulfonate, wt % | | | | |
| Borated Succinimide Dispersant, wt % | | 5.823 | 0 | 5.823 |
| High MW Succinimide Dispersant 2, wt % | | | 0 | 9.9 |
| High MW Succinimide Dispersant 1, wt % | 8.25 | | | |
| Rest of formulation, wt % | 7.07 | 7.07 | 7.07 | 7.07 |

Fig. 4

| | Example 1 | Example 3 | Example 4 | Example 5 | Comparitive Example 1 |
|---|---|---|---|---|---|
| Sulfated Ash, wt % | 1.2 | 1.2 | 0.8 | 1.6 | 1.2 |
| Dispersant Nitrogen, ppm | 990 | 990 | 990 | 990 | 990 |
| Calcium, ppm | 3015 | 3102 | | | 3015 |
| Magnesium, ppm | | | 1365 | 3185 | |
| Boron, ppm | 240 | 240 | 240 | 240 | |
| $[Mg] + [Ca] / [B] + [N]_{dispersant}$ | 2.5 | 2.5 | 1.1 | 2.6 | 3.0 |
| **Normalized LSPI Counts per 25,000 Engine Cycles** | **27** | **21** | **0** | **2** | **46** |

Fig. 4 (Cont.)

| | Comparitive Example 2 | Example 2 | Comparitive Example 5 | Example 11 |
|---|---|---|---|---|
| Sulfated Ash, wt % | 1.2 | 1.2 | 1.2 | 1.2 |
| Dispersant Nitrogen, ppm | 990 | 990 | 0 | 1980 |
| Calcium, ppm | 3015 | 3015 | 3015 | 3015 |
| Magnesium, ppm | | | | |
| Boron, ppm | | 507 | 0 | 507 |
| [Mg] +[Ca] / $[B]+[N]_{dispersant}$ | 3.0 | 2.0 | | 1.2 |
| **Normalized LSPI Counts per 25,000 Engine Cycles** | **43** | **24** | **22** | **36** |

Fig. 5

| | Example 6 | Example 7 | Example 8 | Example 9 | Comparative Example 3 | Example 10 | Comparative Example 4 |
|---|---|---|---|---|---|---|---|
| Group III 1, wt% | 48.8 | 48.8 | 48.8 | 48.8 | 48.8 | 48.8 | 48.8 |
| Group IV 1, wt % | 23.6 | 25.4 | 25.6 | 27.6 | 21.7 | 25.8 | 23.3 |
| Group V 1, wt% | 5.0 | 5.0 | 5.0 | 5.0 | 5.0 | 5.0 | 5.0 |
| Viscosity Index Improver | 2.0 | 2.0 | 2.0 | 2.0 | 2.0 | 2.0 | 2.0 |
| Calcium Salicylate 1, wt % | 3.5 | | | | 3.5 | 3.5 | 3.5 |
| Calcium Salicylate 2, wt % | 2.0 | | | | 2.0 | 2.0 | 2.0 |
| Calcium Sulfonate 1, wt % | | 2.5 | | | | | |
| Calcium Sulfonate 2, wt % | | 1.3 | | | | | |
| Magnesium Sulfonate, wt % | | | 3.5 | 1.5 | | | |
| Borated Succinimide Dispersant, wt % | 2.8 | 2.8 | 2.8 | 2.8 | | 5.8 | 2.8 |
| High MW Succinimide Dispersant 1, wt % | 5.2 | 5.2 | 5.2 | 5.2 | 9.9 | | 5.2 |
| 2° ZDDP, wt % | 0.8 | 0.8 | 0.8 | 0.8 | 0.8 | 0.8 | |
| 1 ° ZDDP, wt % | | | | | | | 1.1 |
| Rest of formulation, wt % | 6.3 | 6.3 | 6.3 | 6.3 | 6.3 | 6.3 | 6.3 |

Fig. 5 (Cont.)

| | Example 12 | Example 13 | Comparitive Example 5 | Example 11 |
|---|---|---|---|---|
| Group III 1, wt% | 48.8 | 48.8 | 48.8 | 48.8 |
| Group IV 1, wt % | 25.5 | 23.8 | 27.6 | 15.9 |
| Group V 1, wt% | 5.0 | 5.0 | 5.0 | 5.0 |
| Viscosity Index Improver | 2.0 | 2.0 | 6.0 | 2.0 |
| Calcium Salicylate 1, wt % | 1.4 | 2.1 | 3.5 | 3.5 |
| Calcium Salicylate 2, wt % | 0.8 | 1.2 | 2.0 | 2.0 |
| Calcium Sulfonate 1, wt % | | | | |
| Calcium Sulfonate 2, wt % | | | | |
| Magnesium Sulfonate, wt % | 1.4 | 2.0 | | |
| Borated Succinimide Dispersant, wt % | 2.8 | 2.8 | 0.0 | 5.8 |
| High MW Succinimide Dispersant 1, wt % | 5.2 | 5.2 | 0.0 | 9.9 |
| 2° ZDDP, wt % | 0.8 | 0.8 | 0.8 | 0.8 |
| 1 ° ZDDP, wt % | | | | |
| Rest of formulation, wt % | 6.3 | 6.3 | 6.3 | 6.3 |

Fig. 6

| | Example 6 | Example 7 | Example 8 | Example 9 | Comparative Example 3 | Example 10 | Comparative Example 4 |
|---|---|---|---|---|---|---|---|
| Sulfated Ash, wt % | 1.2 | 1.2 | 1.6 | 0.8 | 1.2 | 1.2 | 1.2 |
| Dispersant Nitrogen, ppm | 990 | 990 | 990 | 990 | 990 | 990 | 990 |
| Calcium, ppm | 3015 | 3102 | | | 3015 | 3015 | 3015 |
| Magnesium, ppm | | | 3185 | 1365 | | | |
| Boron, ppm | 240 | 240 | 240 | 240 | | 507 | 240 |
| Zinc, ppm | 884 | 884 | 884 | 884 | 884 | 884 | 890 |
| Phosphorus, ppm | 800 | 800 | 800 | 800 | 800 | 800 | 798 |
| ([Mg] +[Ca]+[Zn]+[P]) / ([B]+$[N]_{dispersant}$) | 3.8 | 3.9 | 4.0 | 2.5 | 4.7 | 3.1 | 3.8 |
| **Normalized LSPI Counts per 25,000 Engine Cycles** | **27** | **21** | **2** | **0** | **46** | **24** | **34** |

Fig. 6 (Cont.)

| | Example 12 | Example 13 | Comparitive Example 5 | Example 11 |
|---|---|---|---|---|
| | | | | |
| Sulfated Ash, wt % | 1.2 | 1.6 | 1.2 | 1.2 |
| Dispersant Nitrogen, ppm | 990 | 990 | 0 | 1980 |
| Calcium, ppm | 1206 | 1809 | 3015 | 3015 |
| Magnesium, ppm | 1229 | 1870 | | |
| Boron, ppm | 240 | 240 | 0 | 507 |
| Zinc, ppm | 884 | 884 | 884 | 884 |
| Phosphorus, ppm | 800 | 800 | 800 | 800 |
| ([Mg] +[Ca]+[Zn]+[P]) / ([B]+$[N]_{dispersant}$) | 3.3 | 4.3 | | 1.9 |
| **Normalized LSPI Counts per 25,000 Engine Cycles** | 1 | 13 | 22 | 36 |

Fig. 7

| | | | |
|---|---|---|---|
| Component Description | Example P1 | Example P2 | Example P3 |
| Group IV base stock(s) | 22.12 | 22.94 | 22.39 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 5.50 | 5.50 | 5.50 |
| Mg and/or Ca Sulfonates | | | |
| Borated and/or non-borated succinimides | 9.47 | 8.65 | 9.2 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 7 (Cont.)

| | | | |
|---|---|---|---|
| Component Description | Example P4 | Example P5 | Example P6 |
| Group IV base stock(s) | 28.79 | 28.46 | 24.25 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 0.00 | 0.00 | 4.54 |
| Mg and/or Ca Sulfonates | 0.33 | 0.66 | 0.33 |
| Borated and/or non-borated succinimides | 7.97 | 7.97 | 7.97 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 7 (Cont.)

| | | | |
|---|---|---|---|
| Component Description | Example P7 | Example P8 | Example P9 |
| Group IV base stock(s) | 24.80 | 26.75 | 26.27 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 3.66 | 1.38 | 2.75 |
| Mg and/or Ca Sulfonates | 0.66 | 1.00 | 0.10 |
| Borated and/or non-borated succinimides | 7.97 | 7.97 | 7.97 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 7 (Cont.)

| | | | |
|---|---|---|---|
| Component Description | Example P10 | Example P11 | Example P12 |
| Group IV base stock(s) | 27.57 | 23.61 | 23.42 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 0.55 | 5.50 | 5.50 |
| Mg and/or Ca Sulfonates | 1.00 | | |
| Borated and/or non-borated succinimides | 7.97 | 7.97 | 7.97 |
| Zinc dialkyl dithiophosphate (primary, secondary, and/or mixed) | 0.8 | 0.81 | 1 |
| Rest of Formulation | 8.27 | 8.27 | 8.27 |
| Total | 100 | 100 | 100 |

Fig. 7 (Cont.)

| | |
|---|---|
| Component Description | Example P13 |
| Group IV base stock(s) | 24.33 |
| Group III base stock(s) | 48.84 |
| Group III+ base stock(s) | |
| Group V base stock(s) | 5 |
| Mg and/or Ca Salicylates | 5.50 |
| Mg and/or Ca Sulfonates | |
| Borated and/or non-borated succinimides | 7.97 |
| Zinc dialkyl dithiophosphate (primary, secondary, and/or mixed) | 0.09 |
| Rest of Formulation | 8.27 |
| Total | 100 |

Fig. 8

| | | | |
|---|---|---|---|
| Testing Description | Example P1 | Example P2 | Example P3 |
| KV100 | 8.47 | 8.28 | 8.98 |
| HTHS | 2.86 | 2.76 | 2.66 |
| Ash | 1.2 | 1.2 | 1.3 |
| Ca | 3015 | 3015 | 3015 |
| Mg | 0 | 0 | 0 |
| Zn | 884 | 884 | 884 |
| P | 800 | 800 | 800 |
| B | 50 | 152 | 800 |
| Ndisp | 987 | 988 | 1564 |
| TBN | 9.6 | 9.4 | 8.5 |
| B/Ndisp | 0.05 | 0.15 | 0.51 |
| 2 °/ 1 ° | - | - | - |
| Mg/Ca | 0.00 | 0.00 | 0.00 |
| (Mg+Ca) / (B + Ndisp) | 2.91 | 2.65 | 1.28 |
| (Mg + Ca)/ (Zn + P) | 1.79 | 1.79 | 1.79 |
| (Zn + P) / (B + Ndisp) | 1.62 | 1.48 | 0.71 |
| (Mg+Ca+Zn+P)/ (B + Ndisp) | 4.53 | 4.12 | 1.99 |

Fig. 8 (Cont.)

| Testing Description | Example P4 | Example P5 | Example P6 |
|---|---|---|---|
| KV100 | 7.41 | 7.50 | 8.07 |
| HTHS | 2.47 | 2.49 | 2.66 |
| Ash | 0.3 | 0.5 | 1.2 |
| Ca | 0 | 0 | 2487 |
| Mg | 300 | 601 | 300 |
| Zn | 884 | 884 | 884 |
| P | 800 | 800 | 800 |
| B | 241 | 241 | 241 |
| Ndisp | 991 | 991 | 991 |
| TBN | 2.0 | 3.3 | 9.0 |
| B/Ndisp | 0.24 | 0.24 | 0.24 |
| 2 °/ 1 ° | - | - | - |
| Mg/Ca | - | - | 0.12 |
| (Mg+Ca) / (B + Ndisp) | 0.24 | 0.49 | 2.26 |
| (Mg + Ca)/ (Zn + P) | 0.18 | 0.36 | 1.66 |
| (Zn + P) / (B + Ndisp) | 1.37 | 1.37 | 1.37 |
| (Mg+Ca+Zn+P)/ (B + Ndisp) | 1.61 | 1.85 | 3.63 |

Fig. 8 (Cont.)

| | | | |
|---|---|---|---|
| Testing Description | Example P7 | Example P8 | Example P9 |
| KV100 | 8.03 | 7.78 | 7.74 |
| HTHS | 2.65 | 2.57 | 2.57 |
| Ash | 1.1 | 0.9 | 0.7 |
| Ca | 2005 | 754 | 1508 |
| Mg | 601 | 910 | 91 |
| Zn | 884 | 884 | 884 |
| P | 800 | 800 | 800 |
| B | 241 | 241 | 241 |
| Ndisp | 991 | 991 | 991 |
| TBN | 9.0 | 6.8 | 5.3 |
| B/Ndisp | 0.24 | 0.24 | 0.24 |
| 2 °/ 1 ° | - | - | - |
| Mg/Ca | 0.30 | 1.21 | 0.06 |
| (Mg+Ca) / (B + Ndisp) | 2.12 | 1.35 | 1.30 |
| (Mg + Ca)/ (Zn + P) | 1.55 | 0.99 | 0.95 |
| (Zn + P) / (B + Ndisp) | 1.37 | 1.37 | 1.37 |
| (Mg+Ca+Zn+P)/ (B + Ndisp) | 3.48 | 2.72 | 2.66 |

Fig. 8 (Cont.)

| Testing Description | Example P10 | Example P11 | Example P12 |
|---|---|---|---|
| KV100 | 7.66 | 8.13 | 8.14 |
| HTHS | 2.54 | 2.53 | 2.62 |
| Ash | 0.7 | 1.2 | 1.2 |
| Ca | 302 | 3015 | 3015 |
| Mg | 910 | 0 | 0 |
| Zn | 884 | 635 | 943 |
| P | 800 | 570 | 850 |
| B | 241 | 241 | 241 |
| Ndisp | 991 | 991 | 991 |
| TBN | 5.6 | 9.1 | 9.1 |
| B/Ndisp | 0.24 | 0.24 | 0.24 |
| 2 °/ 1 ° | - | 0.01 | 1.00 |
| Mg/Ca | 3.02 | 0.00 | 0.00 |
| (Mg+Ca) / (B + Ndisp) | 0.98 | 2.45 | 2.45 |
| (Mg + Ca)/ (Zn + P) | 0.72 | 2.50 | 1.68 |
| (Zn + P) / (B + Ndisp) | 1.37 | 0.98 | 1.46 |
| (Mg+Ca+Zn+P)/ (B + Ndisp) | 2.35 | 3.43 | 3.90 |

Fig. 8 (Cont.)

| | |
|---|---|
| Testing Description | Example P13 |
| KV100 | 8.06 |
| HTHS | 2.57 |
| Ash | 1.1 |
| Ca | 3015 |
| Mg | 0 |
| Zn | 96 |
| P | 87 |
| B | 241 |
| Ndisp | 991 |
| TBN | 9.1 |
| B/Ndisp | 0.24 |
| 2 °/ 1 ° | 8.00 |
| Mg/Ca | 0.00 |
| (Mg+Ca) / (B + Ndisp) | 2.45 |
| (Mg + Ca)/ (Zn + P) | 16.46 |
| (Zn + P) / (B + Ndisp) | 0.15 |
| (Mg+Ca+Zn+P)/ (B + Ndisp) | 2.60 |

Fig. 9

| Component Description | Example P14 | Example P15 | Example P16 |
|---|---|---|---|
| Group IV base stock(s) | 22.12 | 22.94 | 22.39 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 5.50 | 5.50 | 5.50 |
| Mg and/or Ca Sulfonates | | | |
| Borated and/or non-borated succinimides | 9.47 | 8.65 | 9.2 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 9 (Cont.)

| Component Description | Example P17 | Example P18 | Example P19 |
|---|---|---|---|
| Group IV base stock(s) | 28.79 | 28.46 | 24.25 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 0.00 | 0.00 | 4.54 |
| Mg and/or Ca Sulfonates | 0.33 | 0.66 | 0.33 |
| Borated and/or non-borated succinimides | 7.97 | 7.97 | 7.97 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 9 (Cont.)

| Component Description | Example P20 | Example P21 | Example P22 |
|---|---|---|---|
| Group IV base stock(s) | 24.80 | 26.75 | 26.27 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 3.66 | 1.38 | 2.75 |
| Mg and/or Ca Sulfonates | 0.66 | 1.00 | 0.10 |
| Borated and/or non-borated succinimides | 7.97 | 7.97 | 7.97 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 9 (Cont.)

| Component Description | Example P23 | Example P24 | Example P25 |
|---|---|---|---|
| Group IV base stock(s) | 27.57 | 23.61 | 23.42 |
| Group III base stock(s) | 48.84 | 48.84 | 48.84 |
| Group III+ base stock(s) | | | |
| Group V base stock(s) | 5 | 5 | 5 |
| Mg and/or Ca Salicylates | 0.55 | 5.50 | 5.50 |
| Mg and/or Ca Sulfonates | 1.00 | | |
| Borated and/or non-borated succinimides | 7.97 | 7.97 | 7.97 |
| Zinc dialkyl dithiophosphate (primary, secondary, and/or mixed) | 0.8 | 0.81 | 1 |
| Rest of Formulation | 8.27 | 8.27 | 8.27 |
| Total | 100 | 100 | 100 |

Fig. 9 (Cont.)

| | |
|---|---|
| Component Description | Example P26 |
| Group IV base stock(s) | 24.33 |
| Group III base stock(s) | 48.84 |
| Group III+ base stock(s) | |
| Group V base stock(s) | 5 |
| Mg and/or Ca Salicylates | 5.50 |
| Mg and/or Ca Sulfonates | |
| Borated and/or non-borated succinimides | 7.97 |
| Zinc dialkyl dithiophosphate (primary, secondary, and/or mixed) | 0.09 |
| Rest of Formulation | 8.27 |
| Total | 100 |

Fig. 10

| Testing Description | Example P14 | Example P15 | Example P16 |
|---|---|---|---|
| KV100 | 6.97 | 6.76 | 7.37 |
| HTHS | 2.43 | 2.33 | 2.26 |
| Ash | 1.2 | 1.2 | 1.3 |
| Ca | 3015 | 3015 | 3015 |
| Mg | 0 | 0 | 0 |
| Zn | 884 | 884 | 884 |
| P | 800 | 800 | 800 |
| B | 50 | 152 | 800 |
| Ndisp | 987 | 988 | 1564 |
| TBN | 9.6 | 9.4 | 8.5 |
| B/Ndisp | 0.05 | 0.15 | 0.51 |
| 2 °/ 1 ° | - | - | - |
| Mg/Ca | 0.00 | 0.00 | 0.00 |
| (Mg+Ca) / (B + Ndisp) | 2.91 | 2.65 | 1.28 |
| (Mg + Ca)/ (Zn + P) | 1.79 | 1.79 | 1.79 |
| (Zn + P) / (B + Ndisp) | 1.62 | 1.48 | 0.71 |
| (Mg+Ca+Zn+P)/ (B + Ndisp) | 4.53 | 4.12 | 1.99 |

Fig. 10 (Cont.)

| Testing Description | Example P17 | Example P18 | Example P19 |
|---|---|---|---|
| KV100 | 5.75 | 5.83 | 6.52 |
| HTHS | 2.00 | 2.02 | 2.23 |
| Ash | 0.3 | 0.5 | 1.2 |
| Ca | 0 | 0 | 2487 |
| Mg | 300 | 601 | 300 |
| Zn | 884 | 884 | 884 |
| P | 800 | 800 | 800 |
| B | 241 | 241 | 241 |
| Ndisp | 991 | 991 | 991 |
| TBN | 2.0 | 3.3 | 9.0 |
| B/Ndisp | 0.24 | 0.24 | 0.24 |
| 2 °/ 1 ° | - | - | - |
| Mg/Ca | - | - | 0.12 |
| (Mg+Ca) / (B + Ndisp) | 0.24 | 0.49 | 2.26 |
| (Mg + Ca)/ (Zn + P) | 0.18 | 0.36 | 1.66 |
| (Zn + P) / (B + Ndisp) | 1.37 | 1.37 | 1.37 |
| (Mg+Ca+Zn+P)/ (B + Ndisp) | 1.61 | 1.85 | 3.63 |

Fig. 10 (Cont.)

| Testing Description | Example P20 | Example P21 | Example P22 |
|---|---|---|---|
| KV100 | 6.45 | 6.15 | 6.14 |
| HTHS | 2.21 | 2.11 | 2.12 |
| Ash | 1.1 | 0.9 | 0.7 |
| Ca | 2005 | 754 | 1508 |
| Mg | 601 | 910 | 91 |
| Zn | 884 | 884 | 884 |
| P | 800 | 800 | 800 |
| B | 241 | 241 | 241 |
| Ndisp | 991 | 991 | 991 |
| TBN | 9.0 | 6.8 | 5.3 |
| B/Ndisp | 0.24 | 0.24 | 0.24 |
| 2 °/ 1 ° | - | - | - |
| Mg/Ca | 0.30 | 1.21 | 0.06 |
| (Mg+Ca) / (B + Ndisp) | 2.12 | 1.35 | 1.30 |
| (Mg + Ca)/ (Zn + P) | 1.55 | 0.99 | 0.95 |
| (Zn + P) / (B + Ndisp) | 1.37 | 1.37 | 1.37 |
| (Mg+Ca+Zn+P)/ (B + Ndisp) | 3.48 | 2.72 | 2.66 |

Fig. 10 (Cont.)

| Testing Description | Example P23 | Example P24 | Example P25 |
|---|---|---|---|
| KV100 | 6.01 | 6.60 | 6.63 |
| HTHS | 2.07 | 2.13 | 2.20 |
| Ash | 0.7 | 1.2 | 1.2 |
| Ca | 302 | 3015 | 3015 |
| Mg | 910 | 0 | 0 |
| Zn | 884 | 635 | 943 |
| P | 800 | 570 | 850 |
| B | 241 | 241 | 241 |
| Ndisp | 991 | 991 | 991 |
| TBN | 5.6 | 9.1 | 9.1 |
| B/Ndisp | 0.24 | 0.24 | 0.24 |
| 2 °/ 1 ° | - | 0.01 | 1.00 |
| Mg/Ca | 3.02 | 0.00 | 0.00 |
| (Mg+Ca) / (B + Ndisp) | 0.98 | 2.45 | 2.45 |
| (Mg + Ca)/ (Zn + P) | 0.72 | 2.50 | 1.68 |
| (Zn + P) / (B + Ndisp) | 1.37 | 0.98 | 1.46 |
| (Mg+Ca+Zn+P)/ (B + Ndisp) | 2.35 | 3.43 | 3.90 |

Fig. 10 (Cont.)

| | |
|---|---|
| Testing Description | Example P26 |
| KV100 | 6.51 |
| HTHS | 2.15 |
| Ash | 1.1 |
| Ca | 3015 |
| Mg | 0 |
| Zn | 96 |
| P | 87 |
| B | 241 |
| Ndisp | 991 |
| TBN | 9.1 |
| B/Ndisp | 0.24 |
| 2 °/ 1 ° | 8.00 |
| Mg/Ca | 0.00 |
| (Mg+Ca) / (B + Ndisp) | 2.45 |
| (Mg + Ca)/ (Zn + P) | 16.46 |
| (Zn + P) / (B + Ndisp) | 0.15 |
| (Mg+Ca+Zn+P)/ (B + Ndisp) | 2.60 |

Fig. 11

| | | | |
|---|---|---|---|
| Component Description | Example P27 | Example P28 | Example P29 |
| Group IV base stock(s) | | | |
| Group III base stock(s) | 40.96 | 41.78 | 41.23 |
| Group III+ base stock(s) | 30 | 30 | 30 |
| Group V base stock(s) | 5 | 5 | 5 |
| Mg and/or Ca Salicylates | 5.50 | 5.50 | 5.50 |
| Mg and/or Ca Sulfonates | | | |
| Borated and/or non-borated succinimides | 9.47 | 8.65 | 9.2 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 11 (Cont.)

| | | | |
|---|---|---|---|
| Component Description | Example P30 | Example P31 | Example P32 |
| Group IV base stock(s) | | | |
| Group III base stock(s) | 47.63 | 47.30 | 43.09 |
| Group III+ base stock(s) | 30 | 30 | 30 |
| Group V base stock(s) | 5 | 5 | 5 |
| Mg and/or Ca Salicylates | 0.00 | 0.00 | 4.54 |
| Mg and/or Ca Sulfonates | 0.33 | 0.66 | 0.33 |
| Borated and/or non-borated succinimides | 7.97 | 7.97 | 7.97 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 11 (Cont.)

| | | | |
|---|---|---|---|
| Component Description | Example P33 | Example P34 | Example P35 |
| Group IV base stock(s) | | | |
| Group III base stock(s) | 43.64 | 45.59 | 45.11 |
| Group III+ base stock(s) | 30 | 30 | 30 |
| Group V base stock(s) | 5 | 5 | 5 |
| Mg and/or Ca Salicylates | 3.66 | 1.38 | 2.75 |
| Mg and/or Ca Sulfonates | 0.66 | 1.00 | 0.10 |
| Borated and/or non-borated succinimides | 7.97 | 7.97 | 7.97 |
| Zinc dialkyl dithiophosphate (primary, secondary, and/or mixed) | 0.8 | 0.8 | 0.8 |
| Rest of Formulation | 8.27 | 8.27 | 8.27 |
| Total | 100 | 100 | 100 |

Fig. 11 (Cont.)

| | | | |
|---|---|---|---|
| Component Description | Example P36 | Example P37 | Example P38 |
| Group IV base stock(s) | | | |
| Group III base stock(s) | 46.41 | 42.45 | 42.26 |
| Group III+ base stock(s) | 30 | 30 | 30 |
| Group V base stock(s) | 5 | 5 | 5 |
| Mg and/or Ca Salicylates | 0.55 | 5.50 | 5.50 |
| Mg and/or Ca Sulfonates | 1.00 | | |
| Borated and/or non-borated succinimides | 7.97 | 7.97 | 7.97 |
| Zinc dialkyl dithiophosphate (primary, secondary, and/or mixed) | 0.8 | 0.81 | 1 |
| Rest of Formulation | 8.27 | 8.27 | 8.27 |
| Total | 100 | 100 | 100 |

Fig. 11 (Cont.)

| | |
|---|---|
| Component Description | Example P39 |
| Group IV base stock(s) | |
| Group III base stock(s) | 43.17 |
| Group III+ base stock(s) | 30 |
| Group V base stock(s) | 5 |
| Mg and/or Ca Salicylates | 5.50 |
| Mg and/or Ca Sulfonates | |
| Borated and/or non-borated succinimides | 7.97 |
| Zinc dialkyl dithiophosphate (primary, secondary, and/or mixed) | 0.09 |
| Rest of Formulation | 8.27 |
| Total | 100 |

Fig. 12

| Testing Description | Example P27 | Example P28 | Example P29 |
|---|---|---|---|
| KV100 | 10.23 | 9.99 | 10.85 |
| HTHS | 3.36 | 3.24 | 3.13 |
| Ash | 1.2 | 1.2 | 1.3 |
| Ca | 3015 | 3015 | 3015 |
| Mg | 0 | 0 | 0 |
| Zn | 884 | 884 | 884 |
| P | 800 | 800 | 800 |
| B | 50 | 152 | 800 |
| Ndisp | 987 | 988 | 1564 |
| TBN | 9.6 | 9.4 | 8.5 |
| B/Ndisp | 0.05 | 0.15 | 0.51 |
| 2 °/ 1 ° | - | - | - |
| Mg/Ca | 0.00 | 0.00 | 0.00 |
| (Mg+Ca) / (B + Ndisp) | 2.91 | 2.65 | 1.28 |
| (Mg + Ca)/ (Zn + P) | 1.79 | 1.79 | 1.79 |
| (Zn + P) / (B + Ndisp) | 1.62 | 1.48 | 0.71 |
| (Mg+Ca+Zn+P)/ (B + Ndisp) | 4.53 | 4.12 | 1.99 |

Fig. 12 (Cont.)

| | | | |
|---|---|---|---|
| Testing Description | Example P30 | Example P31 | Example P32 |
| KV100 | 8.93 | 9.03 | 9.74 |
| HTHS | 2.90 | 2.93 | 3.13 |
| Ash | 0.3 | 0.5 | 1.2 |
| Ca | 0 | 0 | 2487 |
| Mg | 300 | 601 | 300 |
| Zn | 884 | 884 | 884 |
| P | 800 | 800 | 800 |
| B | 241 | 241 | 241 |
| Ndisp | 991 | 991 | 991 |
| TBN | 2.0 | 3.3 | 9.0 |
| B/Ndisp | 0.24 | 0.24 | 0.24 |
| 2 °/ 1 ° | - | - | - |
| Mg/Ca | - | - | 0.12 |
| (Mg+Ca) / (B + Ndisp) | 0.24 | 0.49 | 2.26 |
| (Mg + Ca)/ (Zn + P) | 0.18 | 0.36 | 1.66 |
| (Zn + P) / (B + Ndisp) | 1.37 | 1.37 | 1.37 |
| (Mg+Ca+Zn+P)/ (B + Ndisp) | 1.61 | 1.85 | 3.63 |

Fig. 12 (Cont.)

| | | | |
|---|---|---|---|
| Testing Description | Example P33 | Example P34 | Example P35 |
| KV100 | 9.68 | 9.38 | 9.34 |
| HTHS | 3.11 | 3.02 | 3.02 |
| Ash | 1.1 | 0.9 | 0.7 |
| Ca | 2005 | 754 | 1508 |
| Mg | 601 | 910 | 91 |
| Zn | 884 | 884 | 884 |
| P | 800 | 800 | 800 |
| B | 241 | 241 | 241 |
| Ndisp | 991 | 991 | 991 |
| TBN | 9.0 | 6.8 | 5.3 |
| B/Ndisp | 0.24 | 0.24 | 0.24 |
| 2 °/ 1 ° | - | - | - |
| Mg/Ca | 0.30 | 1.21 | 0.06 |
| (Mg+Ca) / (B + Ndisp) | 2.12 | 1.35 | 1.30 |
| (Mg + Ca)/ (Zn + P) | 1.55 | 0.99 | 0.95 |
| (Zn + P) / (B + Ndisp) | 1.37 | 1.37 | 1.37 |
| (Mg+Ca+Zn+P)/ (B + Ndisp) | 3.48 | 2.72 | 2.66 |

Fig. 12 (Cont.)

| | | | |
|---|---|---|---|
| Testing Description | Example P36 | Example P37 | Example P38 |
| KV100 | 9.23 | 9.81 | 9.83 |
| HTHS | 2.98 | 2.97 | 3.07 |
| Ash | 0.7 | 1.2 | 1.2 |
| Ca | 302 | 3015 | 3015 |
| Mg | 910 | 0 | 0 |
| Zn | 884 | 635 | 943 |
| P | 800 | 570 | 850 |
| B | 241 | 241 | 241 |
| Ndisp | 991 | 991 | 991 |
| TBN | 5.6 | 9.1 | 9.1 |
| B/Ndisp | 0.24 | 0.24 | 0.24 |
| 2 °/ 1 ° | - | 0.01 | 1.00 |
| Mg/Ca | 3.02 | 0.00 | 0.00 |
| (Mg+Ca) / (B + Ndisp) | 0.98 | 2.45 | 2.45 |
| (Mg + Ca)/ (Zn + P) | 0.72 | 2.50 | 1.68 |
| (Zn + P) / (B + Ndisp) | 1.37 | 0.98 | 1.46 |
| (Mg+Ca+Zn+P)/ (B + Ndisp) | 2.35 | 3.43 | 3.90 |

Fig. 12 (Cont.)

| | |
|---|---|
| Testing Description | Example P39 |
| KV100 | 9.73 |
| HTHS | 3.02 |
| Ash | 1.1 |
| Ca | 3015 |
| Mg | 0 |
| Zn | 96 |
| P | 87 |
| B | 241 |
| Ndisp | 991 |
| TBN | 9.1 |
| B/Ndisp | 0.24 |
| 2 °/ 1 ° | 8.00 |
| Mg/Ca | 0.00 |
| (Mg+Ca) / (B + Ndisp) | 2.45 |
| (Mg + Ca)/ (Zn + P) | 16.46 |
| (Zn + P) / (B + Ndisp) | 0.15 |
| (Mg+Ca+Zn+P)/ (B + Ndisp) | 2.60 |

Fig. 13
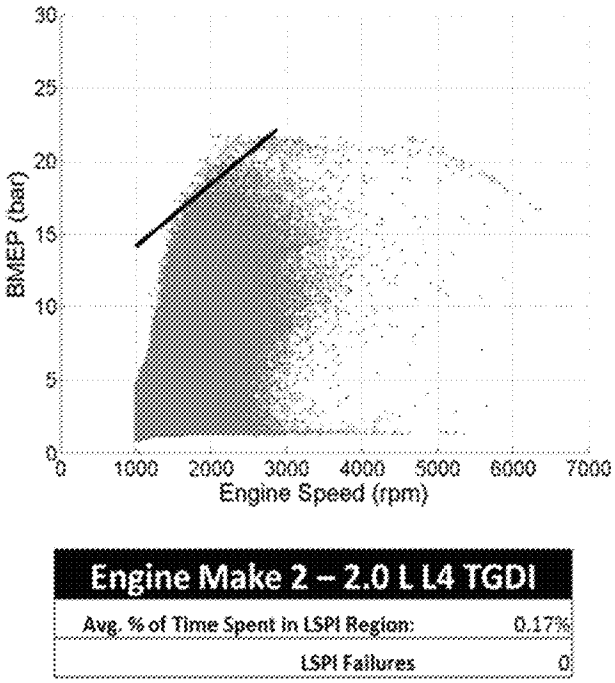
| Engine Make 2 – 2.0 L L4 TGDI | |
|---|---|
| Avg. % of Time Spent in LSPI Region: | 0.17% |
| LSPI Failures | 0 |
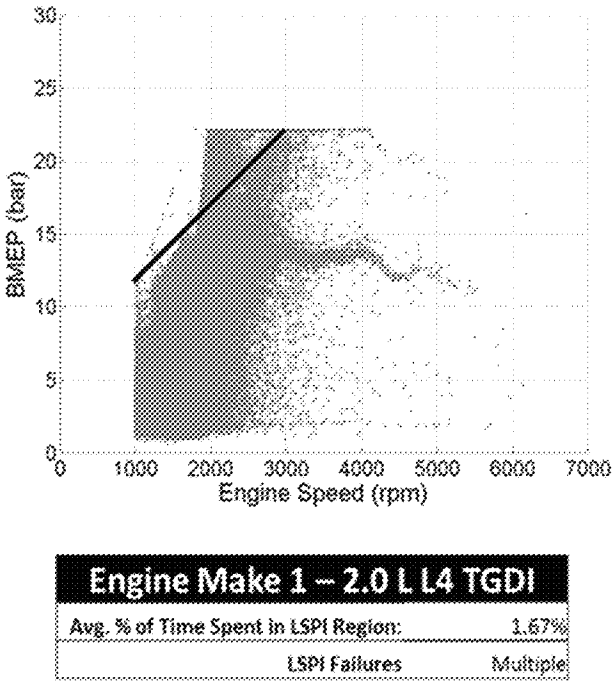
| Engine Make 1 – 2.0 L L4 TGDI | |
|---|---|
| Avg. % of Time Spent in LSPI Region: | 1.67% |
| LSPI Failures | Multiple |

Fig. 14

| | Comparative Example 6 | Comparative Example 7 | Comparative Example 8 | Example 14 | Example 15 | Example 16 | Example 17 | Example 1 | Example 11 |
|---|---|---|---|---|---|---|---|---|---|
| Group III 1, wt% | 30.0 | 30.0 | 0.0 | 30.0 | 0.0 | 0.0 | 30.0 | 0.0 | 0.0 |
| Group III 2, wt% | 10.0 | 10.0 | 0.0 | 10.0 | 0.0 | 0.0 | 10.0 | 0.0 | 0.0 |
| Group III 3, wt% | 0.0 | 0.0 | 48.8 | 0.0 | 48.8 | 48.8 | 0.0 | 48.8 | 48.8 |
| Group IV 1, wt % | 35.3 | 34.8 | 25.6 | 34.8 | 16.3 | 23.3 | 33.1 | 23.6 | 15.9 |
| Group V 1, wt% | 5.0 | 5.0 | 5.0 | 5.0 | 5.0 | 5.0 | 5.0 | 5.0 | 5.0 |
| Viscosity Index Improver 1 | 8.7 | 8.5 | 0.0 | 8.5 | 0.0 | 0.0 | 8.5 | 0.0 | 0.0 |
| Viscosity Index Improver 2 | 0.0 | 0.0 | 3.4 | 0.0 | 1.0 | 0.0 | 0.0 | 2.0 | 2.0 |
| Viscosity Index Improver 3 | 0.0 | 0.0 | 4.0 | 0.0 | 4.0 | 4.0 | 0.0 | 4.0 | 4.0 |
| Borated Succinimide Dispersant 1, wt % | 2.4 | 0.0 | 0.0 | 0.0 | 0.6 | 1.6 | 1.3 | 2.8 | 5.8 |
| Borated Succinimide Dispersant 2, wt % | 0.0 | 3.3 | 2.0 | 0.0 | 0.0 | 0.0 | 0.0 | 0.0 | 0.0 |
| High MW Succinimide Dispersant 1, wt % | 0.0 | 0.0 | 2.7 | 0.0 | 9.0 | 7.2 | 0.0 | 5.2 | 9.9 |
| High MW Succinimide Dispersant 2, wt % | 0.0 | 0.0 | 0.0 | 0.0 | 0.0 | 0.0 | 3.3 | 0.0 | 0.0 |
| High MW Succinimide Dispersant 3, wt % | 0.0 | 0.0 | 0.0 | 2.9 | 0.0 | 0.0 | 0.0 | 0.0 | 0.0 |
| Ca salicylate 1 | 1.8 | 1.7 | 3.5 | 2.0 | 3.5 | 3.5 | 2.0 | 3.5 | 3.5 |
| Ca salicylate 2 | 3.0 | 3.0 | 2.0 | 3.0 | 2.0 | 2.0 | 3.0 | 2.0 | 2.0 |
| Other Lubricating Additives, wt % | 3.8 | 3.8 | 3.1 | 3.8 | 9.8 | 4.6 | 3.8 | 3.1 | 3.1 |
| | | | | | | | | | |
| Sulfated Ash, wt % | 0.9 | 1.0 | 1.3 | 0.9 | 1.2 | 1.2 | 0.9 | 1.2 | 1.2 |
| Calcium, ppm | 2180 | 2180 | 3015 | 2180 | 3015 | 3015 | 2180 | 3015 | 3015 |
| Magnesium, ppm | 0 | 0 | 0 | 0 | 0 | 0 | 0 | 0 | 0 |
| Dispersant Nitrogen, ppm | 410 | 1190 | 500 | 410 | 990 | 990 | 820 | 990 | 1980 |
| Boron, ppm | 209 | 800 | 500 | 0 | 50 | 140 | 100 | 240 | 500 |
| $[B]/[N]_{dispersant}$ | **0.5** | **0.7** | **1** | **0** | **0.05** | **0.1** | **0.1** | **0.2** | **0.3** |
| **FLSPI Test, Counts** | -- | -- | 16 | -- | 14 | 15 | -- | 21 | 16 |
| **GM LSPI Test, Events** | 1 | 1 | -- | 1 | -- | -- | 1 | -- | -- |
| TEOST 33C Rod deposits, mg | 56 | 52 | 45 | 15 | 34 | 24 | 23 | 12 | 15 |

Fig. 15

| | Comparative Example 1 | Comparative Example 9 | Example 18 | Example 19 |
|---|---|---|---|---|
| Group III 3, wt% | 48.8 | 48.8 | 48.8 | 48.8 |
| Group IV 1, wt % | 21.7 | 22.7 | 27.6 | 24.2 |
| Group V 1, wt% | 5.0 | 5.0 | 5.0 | 5.0 |
| Viscosity Index Improver 2 | 2.0 | 3.9 | 6.0 | 6.4 |
| Viscosity Index Improver 3 | 4.0 | 4.0 | 4.0 | 4.0 |
| Borated Succinimide Dispersant 1, wt % | 0.0 | 0.0 | 0.0 | 0.0 |
| High MW Succinimide Dispersant 1, wt % | 9.9 | 7.0 | 0.0 | 3.0 |
| Ca salicylate 1 | 3.5 | 3.5 | 3.5 | 3.5 |
| Ca salicylate 2 | 2.0 | 2.0 | 2.0 | 2.0 |
| Rest of formulation, wt % | 3.1 | 3.1 | 3.1 | 3.1 |
| | | | | |
| Sulfated Ash, wt % | 1.2 | 1.2 | 1.2 | 1.2 |
| Calcium, ppm | 3015 | 3015 | 3015 | 3015 |
| Magnesium, ppm | 0 | 0 | 0 | 0 |
| Dispersant Nitrogen, ppm | 990 | 700 | 0 | 300 |
| Boron, ppm | 0 | 0 | 0 | 0 |
| $[B]/[N]_{dispersant}$ | **0** | **0** | **0** | **0** |
| **P3 LSPI Test, Counts** | **46** | -- | **22** | -- |
| **FLSPI Test, Counts** | -- | **20** | -- | **14** |

Fig. 16

| | Comparative Example 1 | Comparative Example 2 | Comparative Example 10 | Example 1 | Example 3 | Example 20 | Example 21 |
|---|---|---|---|---|---|---|---|
| Group III 1, wt% | 0.0 | 0.0 | 30 | 0.0 | 0.0 | 0.0 | 30 |
| Group III 2, wt% | 0.0 | 0.0 | 10 | 0.0 | 0.0 | 0.0 | 10 |
| Group III 3, wt% | 48.8 | 48.8 | 0.0 | 48.8 | 48.8 | 48.8 | 0.0 |
| Group IV 1, wt % | 21.7 | 23.3 | 34.4 | 23.6 | 25.4 | 23.3 | 33.1 |
| Group V 1, wt% | 5.0 | 5.0 | 5.0 | 5.0 | 5.0 | 5.0 | 5.0 |
| Viscosity Index Improver 1 | 0.0 | 0.0 | 8.5 | 0.0 | 0.0 | 0.0 | 8.5 |
| Viscosity Index Improver 2 | 2.0 | 2.0 | 0.0 | 2.0 | 2.0 | 2.0 | 0.0 |
| Viscosity Index Improver 3 | 4.0 | 4.0 | 0.0 | 4.0 | 4.0 | 4.0 | 0.0 |
| Borated Succinimide Dispersant 1, wt % | 0.0 | 0.0 | 0.0 | 2.8 | 2.8 | 2.8 | 1.3 |
| Borated Succinimide Dispersant 2, wt % | 0.0 | 0.0 | 0.0 | 0.0 | 0.0 | 0.0 | 0.0 |
| High MW Succinimide Dispersant 1, wt % | 9.9 | 0.0 | 0.0 | 5.2 | 5.2 | 5.2 | 0.0 |
| High MW Succinimide Dispersant 2, wt % | 0.0 | 8.3 | 3.3 | 0.0 | 0.0 | 0.0 | 3.3 |
| Ca salicylate 1 | 3.5 | 3.5 | 2.0 | 3.5 | 0.0 | 0.0 | 2.0 |
| Ca salicylate 2 | 2.0 | 2.0 | 3.0 | 2.0 | 0.0 | 0.0 | 3.0 |
| Ca sulfonate 1 | 0.0 | 0.0 | 0.0 | 0.0 | 2.5 | 0.0 | 0.0 |
| Ca sulfonate 2 | 0.0 | 0.0 | 0.0 | 0.0 | 1.3 | 0.0 | 0.0 |
| Ca phenate | 0.0 | 0.0 | 0.0 | 0.0 | 0.0 | 5.8 | 0.0 |
| Rest of formulation, wt % | 3.1 | 3.1 | 3.8 | 3.1 | 3.1 | 3.1 | 3.8 |
| | | | | | | | |
| Sulfated Ash, wt % | 1.2 | 1.2 | 0.9 | 1.2 | 1.2 | 1.2 | 0.9 |
| Calcium, ppm | 3015 | 3015 | 2180 | 3015 | 3102 | 3190 | 2180 |
| Magnesium, ppm | 0 | 0 | 0 | 0 | 0 | 0 | 0 |
| Dispersant Nitrogen, ppm | 990 | 990 | 410 | 990 | 990 | 990 | 820 |
| Boron, ppm | **0** | **0** | **0** | **240** | **240** | **240** | **113** |
| $[B]/[N]_{dispersant}$ | **0** | **0** | **0** | **0.2** | **0.2** | **0.2** | **0.1** |
| **P3 LSPI Test, Counts** | **46** | **43** | -- | **27** | **21** | **27** | -- |
| **GM LSPI Test, Events** | -- | -- | **10** | -- | -- | -- | **3** |

METHOD FOR PREVENTING OR REDUCING LOW SPEED PRE-IGNITION WHILE MAINTAINING OR IMPROVING CLEANLINESS

CROSS-REFERENCE TO RELATED APPLICATIONS

This application is a Continuation-in-Part Application and claims priority to pending U.S. application Ser. No. 14/706,190, filed on May 7, 2015, the entirety of which is incorporated herein by reference, which claims the benefit of U.S. Provisional Application No. 61/990,764 filed May 9, 2014, herein also incorporated by reference in its entirety.

RELATED APPLICATIONS

This application is related to two other co-pending applications identified by the following Ser. No. 14/706,161 entitled "Method for Preventing or Reducing Low Speed Pre-Ignition" and Ser. No. 14/706,293 entitled "Method for Preventing or Reducing Low Speed Pre-Ignition"; all of which are incorporated herein in their entirety by reference.

FIELD

This disclosure relates to a method for preventing or reducing low speed pre-ignition (LSPI) in an engine lubricated with a lubricating oil while maintaining or improving cleanliness by using as the lubricating oil a formulated oil that has at least one boron-containing compound, preferably at least one borated dispersant, or a mixture of a boron-containing compound and a dispersant, present in a particular amount in the formulated oil. The lubricating oils of this disclosure are useful as passenger vehicle engine oil (PVEO) products.

BACKGROUND

Pre-ignition in a flame propagation (or "spark-ignition") engine describes an event wherein the air/fuel mixture in the cylinder ignites before the spark plug fires. Pre-ignition is initiated by an ignition source other than the spark, such as hot spots in the combustion chamber, a spark plug that runs too hot for the application, or carbonaceous deposits in the combustion chamber heated to incandescence by previous engine combustion events.

Many passenger car manufacturers have observed intermittent pre-ignition in their production turbocharged gasoline engines, particularly at low speeds and medium-to-high loads. At these elevated loads, pre-ignition usually results in severe engine knock that can damage the engine. The cause of the pre-ignition is not fully understood, and may in fact be attributed to multiple phenomena such as hot deposits within the combustion chamber, elevated levels of lubricant vapor entering from the PCV (positive crankcase ventilation) system, oil seepage past the turbocharger compressor seals or oil and/or fuel droplet auto-ignition during the compression stroke.

Pre-ignition can sharply increase combustion chamber temperatures and lead to rough engine operation or loss of performance. Traditional methods of eliminating pre-ignition include, for example, proper spark plug selection, proper fuel/air mixture adjustment, and periodic cleaning of the combustion chambers. Hardware solutions such as cooled exhaust gas recirculation (EGR) are known, but these can be costly to implement and present packaging problems.

Low speed pre-ignition (LSPI) is a type of abnormal combustion affecting engines operating at high brake mean effective pressure (BMEP) and low engine speed (RPM). This includes internal combustion engines using a variety of fuels, including natural gas, gasoline, diesel, biofuels, and the like. Downsized, downspeeded, turbocharged engines are most susceptible to operating under these engine conditions and are thus more susceptible to LSPI. As the automobile industry continues to move towards further downsizing, downspeeding, and increased turbocharging to increase vehicle fuel economy and reduce carbon dioxide emissions, the concern over LSPI continues to grow.

The further development of downspeeded, turbocharged gasoline engines is being impeded by LSPI. A solution to this problem or even a mitigation of its occurrence would remove barriers for original equipment manufacturer (OEM) technology and efficiency improvement. A lubricant formulation solution would enable product differentiation with regard to LSPI.

Although pre-ignition problems can be and are being resolved by optimization of internal engine components and by the use of new component technology such as electronic controls, modification of the lubricating oil compositions used to lubricate such engines is desirable. For example, it would be desirable develop new lubricating oil formulations which are particularly useful in internal combustion engines and, when used in internal combustion engines, will prevent or minimize the pre-ignition problems. It is desired that the lubricating oil composition be useful in lubricating gasoline-fueled, spark-ignited engines.

Despite the advances in lubricant oil formulation technology, there exists a need for an engine oil lubricant that effectively prevents or reduces low speed pre-ignition especially for downsized, downspeeded, turbocharged engines while maintaining or improving cleanliness performance.

SUMMARY

This disclosure relates in part to new lubricating oil formulations which are particularly useful in internal combustion engines and, when used in internal combustion engines will prevent or minimize pre-ignition problems. The lubricating oil compositions of this disclosure are useful in lubricating gasoline-fueled, spark-ignited engines. The lubricant formulation chemistry of this disclosure can be used to prevent or control the detrimental effect of LSPI in engines which have already been designed or sold in the marketplace as well as future engine technology. The lubricant formulation chemistry of this disclosure removes barriers for OEM technology and efficiency improvement, and enables further development of downspeeded, turbocharged gasoline engines that is currently being impeded by LSPI. The lubricant formulation solution afforded by this disclosure for preventing or reducing LSPI enables product differentiation with regard to LSPI while maintaining or improving cleanliness performance.

This disclosure also relates in part to a method for preventing or reducing low speed pre-ignition in an engine lubricated with a lubricating oil while maintaining or improving cleanliness performance by using as the lubricating oil a formulated oil. The formulated oil has a composition comprising a lubricating oil base stock as a major component; and at least one boron-containing compound, as a minor component. The at least one boron-containing compound comprises at least one borated dispersant, or a mixture of a boron-containing compound and dispersant. The engine exhibits greater than about 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil that does not comprise at least one borated dispersant, or a mixture of a boron-containing compound and a non-borated dispersant.

This disclosure further relates in part to a method for preventing or reducing low speed pre-ignition in an engine lubricated with lubricating oil by using as the lubricating oil a formulated oil as described above, in which the minor component further comprises at least one detergent. The detergent comprises at least one alkaline earth metal salt of an organic acid, and the at least one alkaline earth metal salt of an organic acid comprises at least one magnesium salt of an organic acid.

This disclosure yet further relates in part to a method for preventing or reducing low speed pre-ignition in an engine lubricated with a lubricating oil while maintaining or improving cleanliness performance by using as the lubricating oil a formulated oil as described above, in which the minor component further comprises at least one detergent, and at least one zinc-containing compound or at least one antiwear agent. The detergent comprises at least one alkaline earth metal salt of an organic acid, and the at least one alkaline earth metal salt of an organic acid comprises at least one magnesium salt of an organic acid. The at least one antiwear agent comprises at least one zinc dialkyl dithiophosphate compound derived from a secondary alcohol or derived in part from a secondary alcohol.

This disclosure also relates in part to a lubricating engine oil having a composition comprising a lubricating oil base stock as a major component; and at least one boron-containing compound, as a minor component. The at least one boron-containing compound comprises at least one borated dispersant, and/or a mixture of a boron-containing compound and a non-borated dispersant. The engine exhibits greater than about 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil that does not comprise at least one borated dispersant, or a mixture of a boron-containing compound and a non-borated dispersant.

This disclosure further relates in part to a lubricating engine oil as described above, in which the minor component further comprises at least one detergent. The detergent comprises at least one alkaline earth metal salt of an organic acid, and the at least one alkaline earth metal salt of an organic acid comprises at least one magnesium salt of an organic acid.

This disclosure yet further relates in part to a lubricating engine oil as described above, in which the minor component further comprises at least one detergent, and at least one zinc-containing compound or at least one antiwear agent. The detergent comprises at least one alkaline earth metal salt of an organic acid, and the at least one alkaline earth metal salt of an organic acid comprises at least one magnesium salt of an organic acid. The at least one antiwear agent comprises at least one zinc dialkyl dithiophosphate compound derived from a secondary alcohol.

It has been surprisingly found that, in accordance with this disclosure, prevention or reduction of LSPI can be attained in an engine lubricated with a lubricating oil while maintaining or improving cleanliness performance by using as the lubricating oil a formulated oil that includes at least one boron-containing compound (e.g., borated succinimide), preferably at least one borated dispersant, or a mixture of a boron-containing compound and a non-borated dispersant, present in a particular amount (e.g., from about 0.1 to about 20 weight percent, based on the total weight of the lubricating oil), in the lubricating oil. In particular, for lubricating oil formulations containing the at least one boron-containing compound, it has been surprisingly found that the engine exhibits greater than about 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil that does not comprise at least one borated dispersant, or a mixture of a boron-containing compound and a non-borated dispersant In addition, it has been surprisingly found that, in accordance with this disclosure, reduction of LSPI can be attained in an engine lubricated with a lubricating oil by using as the lubricating oil a formulated oil that has a particular base stock (e.g., a gas-to-liquids base stock or an ester base stock).

This disclosure also relates to a method for preventing or reducing low speed pre-ignition in an engine lubricated with a lubricating oil by using as the lubricating oil a formulated engine oil, said formulated engine oil having a composition comprising at least one lubricating oil base stock at from 70 to 85 wt. %; and at least one dispersant at a loading to contribute from 30 to 1500 ppm of boron to the formulated engine oil, wherein said at least one dispersant comprises at least one borated dispersant, or a mixture of a boron-containing compound and a non-borated dispersant, wherein the engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil that does not comprise at least one borated dispersant, or a mixture of a boron-containing compound and a non-borated dispersant.

This disclosure still also relates to a method for preventing or reducing low speed pre-ignition in a spark ignited internal combustion engine lubricated with a lubricating oil while maintaining or improving deposit control comprising the steps of: lubricating a spark ignited internal combustion engine with a lubricating oil comprising a lubricating oil base stock as a major component; and at least one boron-containing compound and at least one overbased calcium detergent, as minor components; wherein said at least one boron-containing compound comprises at least one borated dispersant, or a mixture of a boron-containing compound and a non-borated dispersant, wherein the boron to nitrogen ratio for the at least one boron-containing compound is less than or equal to about 0.3 with the proviso that the lubricating oil is essentially free of elemental magnesium; and measuring the deposit control of the lubricating oil and the low speed pre-ignition of the spark ignited internal combustion engine lubricated with the lubricating oil;

wherein the spark ignited internal combustion engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in a spark ignited internal combustion engine using a lubricating oil that does not comprise the at least one boron-containing compound and the at least one overbased calcium detergent, and wherein the deposit control is maintained or improved (TEOST 33C total deposits less than or equal to 34 mg) as compared to deposit control achieved using a lubricating oil not containing the at least one boron-containing compound and the at least one overbased calcium detergent.

This disclosure still yet also relates to a method for preventing or reducing low speed pre-ignition in an engine lubricated with a lubricating oil while maintaining or improving deposit control comprising the steps of: method for preventing or reducing low speed pre-ignition in a spark ignited internal combustion engine lubricated with a lubricating oil comprising the steps of: lubricating a spark ignited internal combustion engine with a lubricating oil comprising at least one lubricating oil base stock at from 70 to 85 wt. % based on the total weight of the lubricating oil; and at least one dispersant at a loading to contribute from 30 to 1500 ppm of boron to the oil, wherein said at least one dispersant comprises at least one borated dispersant, or a mixture of a boron-containing compound and a non-borated dispersant, wherein the boron to nitrogen ratio for the at least one dispersant is less than or equal to about 0.3 and at least one overbased calcium detergent at 1.0 to 6.0 wt. % based on the total weight of the lubricating oil with the proviso that the lubricating oil is free of elemental magnesium, and measuring the deposit control of the lubricating oil and the low speed pre-ignition of the spark ignited internal combustion engine lubricated with the lubricating oil, wherein the spark ignited internal combustion engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in a spark ignited internal combustion engine using a lubricating oil that does not comprise the at least one borated dispersant, or a mixture of a boron-containing compound and a non-borated dispersant and the at least one overbased calcium detergent, and wherein the deposit control is maintained or improved (TEOST 33C total deposits less than or equal to 34 mg) as compared to deposit control achieved using a lubricating oil not containing the at least one borated dispersant, or a mixture of a boron-containing compound and a non-borated dispersant and the at least one overbased calcium detergent.

Other objects and advantages of the present disclosure will become apparent from the detailed description that follows.

BRIEF DESCRIPTION OF THE DRAWINGS

All concentrations indicated in the drawings are quoted on a "as delivered" basis.

FIG. 1 shows formulation details in weight percent based on the total weight percent of the formulation, of various lubricating oil formulations, and the results of testing the various lubricating oil formulations, as detailed in Example A.

FIG. 3 shows formulation details in weight percent based on the total weight percent of the formulation, of various lubricating oil formulations, as detailed in Example B.

FIG. 4 shows the results of testing the various lubricating oil formulations set forth in FIG. 3, as detailed in Example B.

FIG. 5 shows formulation details in weight percent based on the total weight percent of the formulation, of various lubricating oil formulations, as detailed in Example C.

FIG. 6 shows the results of testing the various lubricating oil formulations set forth in FIG. 5, as detailed in Example C.

FIG. 7 shows formulation details in weight percent based on the total weight percent of the formulation, of the formulation embodiments of this disclosure, as detailed in Example D.

FIG. 8 shows the expected results of testing the various lubricating oil formulations of FIG. 7, as detailed in Example D.

FIG. 9 shows formulation details in weight percent based on the total weight percent of the formulation, of the formulation embodiments of this disclosure, as detailed in Example E.

FIG. 10 shows the expected results of testing the various lubricating oil formulations of FIG. 9, as detailed in Example E.

FIG. 11 shows formulation details in weight percent based on the total weight percent of the formulation, of the formulation embodiments of this disclosure, as detailed in Example F.

FIG. 12 shows the expected results of testing the various lubricating oil formulations of FIG. 11, as detailed in Example F.

FIG. 13 shows the results of engine performance mapping as detailed in Example A.

FIG. 14 shows formulation details in weight percent based on the total weight percent of the formulation, of various comparative and inventive lubricating oil formulations and LSPI and cleanliness performance results, as detailed in Example G.

FIG. 15 shows formulation details in weight percent based on the total weight percent of the formulation, of various comparative and inventive lubricating oil formulations and LSPI performance results, as detailed in Example H.

FIG. 16 shows formulation details in weight percent based on the total weight percent of the formulation, of various comparative and inventive lubricating oil formulations and LSPI performance results, as detailed in Example I.

DETAILED DESCRIPTION

Figure 2:
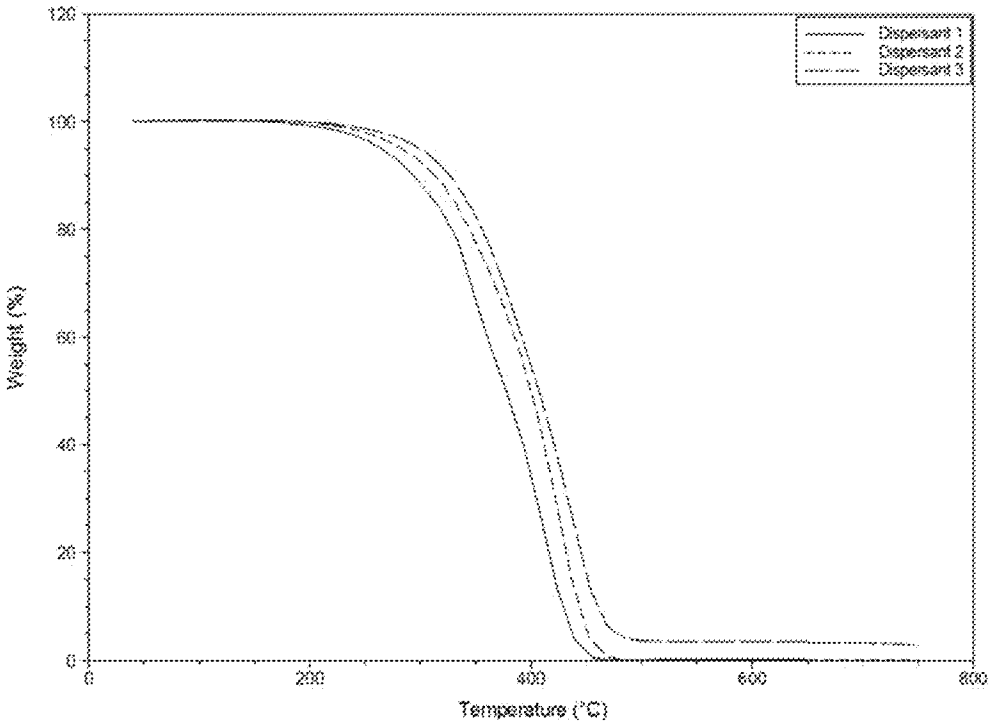
FIG. 2 graphically depicts thermogravimetric analysis curves for three different dispersants as detailed in Example A.

All numerical values within the detailed description and the claims herein are modified by "about" or "approximately" the indicated value, and take into account experimental error and variations that would be expected by a person having ordinary skill in the art. The phrase "major amount" as it relates to components included within the lubricating oils of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the lubricating oil. The phrase "minor amount" as it relates to components included within the lubricating oils of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the lubricating oil. The phrase "essentially free" as it relates to components included within the lubricating oils of the specification and the claims means that the particular component is at 0 weight % within the lubricating oil, or alternatively is at impurity type levels within the lubricating oil (less than 100 ppm, or less than 20 ppm, or less than 10 ppm, or less than 1 ppm). The phrase "other lubricating oil additives" as used in the specification and the claims means other lubricating oil additives that are not specifically recited in the particular section of the specification or the claims. For example, other lubricating oil additives may include, but are not limited to, antioxidants, detergents, dispersants, antiwear additives, corrosion inhibitors, viscosity modifiers, metal passivators, pour point depressants, seal compatibility agents, antifoam agents, extreme pressure agents, friction modifiers and combinations thereof.

It has now been surprisingly and unexpectedly found that prevention or reduction of LSPI can be attained in an engine lubricated with a lubricating oil and cleanliness/deposits maintained or improved by using as the lubricating oil a formulated oil that includes at least one boron-containing compound (e.g., borated succinimide), preferably at least one borated dispersant, or a mixture of a boron-containing compound and a non-borated dispersant, present in a particular amount (e.g., from about 0.1 to about 20 weight percent, based on the total weight of the lubricating oil) and at least one overbased calcium detergent in the lubricating oil. In addition, it has been found that reduction of LSPI can be attained in an engine lubricated with a lubricating oil by using as the lubricating oil a formulated oil that has a particular base stock. The formulated oil preferably has a composition comprising a lubricating oil base stock as a major component, and at least one boron-containing compound, as a minor component. The at least one boron-containing compound comprises at least one borated dispersant, or a mixture of a boron-containing compound and a non-borated dispersant. The lubricating oils of this disclosure are particularly advantageous in internal combustion engines using a variety of fuels including natural gas, gasoline, diesel, biofuels and the like, and for a variety of applications including passenger vehicle engine oils and natural gas engine oils.

In one form of the present disclosure, provided is a method for preventing or reducing low speed pre-ignition in a spark ignited internal combustion engine lubricated with a lubricating oil while maintaining or improving deposit control comprising the steps of: lubricating a spark ignited internal combustion engine with a lubricating oil comprising a lubricating oil base stock as a major component; and at least one boron-containing compound and at least one overbased calcium detergent, as minor components; wherein said at least one boron-containing compound comprises at least one borated dispersant, or a mixture of a boron-containing compound and a non-borated dispersant, wherein the boron to nitrogen ratio for the at least one boron-containing compound is less than or equal to about 0.3 with the proviso that the lubricating oil is essentially free of elemental magnesium and measuring the deposit control of the lubricating oil and the low speed pre-ignition of the spark ignited internal combustion engine lubricated with the lubricating oil. The spark ignited internal combustion engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in a spark ignited internal combustion engine using a lubricating oil that does not comprise the at least one boron-containing compound and the at least one overbased calcium detergent, and the deposit control is maintained or improved (TEOST 33C total deposits less than or equal to 34 mg) as compared to deposit control achieved using a lubricating oil not containing the at least one boron-containing compound and the at least one overbased calcium detergent.

In another form of the present disclosure, provided is a method for preventing or reducing low speed pre-ignition in a spark ignited internal combustion engine lubricated with a lubricating oil comprising the steps of: lubricating a spark ignited internal combustion engine with a lubricating oil comprising at least one lubricating oil base stock at from 70 to 85 wt. % based on the total weight of the lubricating oil; and at least one dispersant at a loading to contribute from 30 to 1500 ppm of boron to the oil, wherein said at least one dispersant comprises at least one borated dispersant, or a mixture of a boron-containing compound and a non-borated dispersant, wherein the boron to nitrogen ratio for the at least one dispersant is less than or equal to about 0.3 and at least one overbased calcium detergent at 1.0 to 6.0 wt. % based on the total weight of the lubricating oil with the proviso that the lubricating oil is free of elemental magnesium, and measuring the deposit control of the lubricating oil and the low speed pre-ignition of the spark ignited internal combustion engine lubricated with the lubricating oil. The spark ignited internal combustion engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in a spark ignited internal combustion engine using a lubricating oil that does not comprise the at least one borated dispersant, or a mixture of a boron-containing compound and a non-borated dispersant and the at least one overbased calcium detergent, and the deposit control is maintained or improved (TEOST 33C total deposits less than or equal to 34 mg) as compared to deposit control achieved using a lubricating oil not containing the at least one borated dispersant, or a mixture of a boron-containing compound and a non-borated dispersant and the at least one overbased calcium detergent.

The lubricating oils of the instant disclosure may also include one or more other lubricating oil additives, which constitute the remainder of the formulated oil and are selected from one or more of the following: anti-wear additive, viscosity index improver, antioxidant, other detergent, other dispersant, pour point depressant, corrosion inhibitor, metal deactivator, seal compatibility additive, anti-foam agent, inhibitor, anti-rust additive, and organic metallic friction. These one or more other lubricating oil additives are described in greater detail below.

The inventive lubricating oils of the instant disclosure including at least one boron-containing compound having a boron to nitrogen ratio (B:N ratio) ranging from 0 to 0.3, or 0.02 to 0.28, or 0.04 to 0.26, or 0.06 to 0.24, or 0.08 to 0.22, or 0.10 to 0.22, or 0.12 to 0.18 or 0.14 to 0.16. The inventive lubricating oils may also include at least one overbased calcium detergent. Calcium salicylate and calcium sulfonate are particularly preferred overbased calcium detergents. The inventive lubricating oils of the instant disclosure are also essentially free of elemental magnesium. Essentially free of elemental magnesium means less than 10 ppm, or less than 5 ppm, or less than 1 ppm, or 0 ppm loading based on the total weight of the lubricating oil.

The inventive lubricating oils of the instant disclosure provide for improved cleanliness in terms of less deposits as measured by the TEOST 33C deposits tests by yielding deposits of less than or equal to 34 mg, or less than or equal to 30 mg, or less than or equal to 25 mg, or less than or equal to 20 mg, or less than or equal to 15 mg. The inventive lubricating oils of the instant disclosure also provide for the preventing or reducing low speed pre-ignition in a spark ignited internal combustion engine lubricated with a lubricating oil by yielding an acceptable LSPI performance. In the Ford LSPI test, this equates to less than or equal to 27 counts, or less than or equal to 25 counts, or less than or equal to 23 counts, or less than or equal to 21 counts, or less than or equal to 19 counts, or less than or equal to 17 counts, or less than or equal to 15 counts. In the GM LSPI test, this equates to less than or equal to 5 events, or less than or equal to 4 events, or less than or equal to 3 events, or less than or equal to 2 events, or less than or equal to 1 event.

The Applicants have also surprisingly and unexpectedly discovered that when the inventive lubricating oils of the instant disclosure have a B:N ratio of 0 and a dispersant nitrogen concentration of less than 700 ppm, or less than or equal to 600 ppm, or less than or equal to 500 ppm, or less than or equal to 400 ppm, or less than or equal to 300 ppm, or less than or equal to 200 ppm, or less than or equal to 100 ppm, there is a significant improvement in LSPI performance for both the Ford and GM tests.

The lubricating oils of this disclosure are particularly useful in internal combustion engines and, when used in internal combustion engines, will prevent or minimize pre-ignition problems. The lubricating oil compositions of this disclosure are useful in lubricating gasoline-fueled, spark-ignited engines.

As described herein, the lubricant formulation chemistry of this disclosure can be used to prevent or control the detrimental effect of LSPI in engines which have already been designed or sold in the marketplace as well as future engine technology. The lubricant formulation chemistry of this disclosure removes barriers for OEM technology and efficiency improvement, and enables further development of downspeeded, turbocharged gasoline engines that is currently being impeded by LSPI. The lubricant formulation solution afforded by this disclosure for preventing or reducing LSPI enables product differentiation with regard to LSPI.

Lubricating Oil Base Stocks

A wide range of lubricating base oils is known in the art. Lubricating base oils that are useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_6$, $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_6$ to about $C_{16}$ alphaolefins, such as 1-hexene, 1-octene, 1-decene, 1-dodecene, 1-tetradecene, and the like, being preferred. The preferred polyalphaolefins are poly-1-hexene, poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Bi-modal mixtures of PAO fluids having a viscosity range of 1.5 to 150 cSt may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of mono-carboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 or more carbon atoms. These esters are widely available commercially, for example, the Mobil P-41 and P-51 esters of ExxonMobil Chemical Company.

Preferred synthetic esters useful in this disclosure have a kinematic viscosity at 100° C. of about 3 cSt to about 50 cSt, preferably about 3 cSt to about 30 cSt, more preferably about 3.5 cSt to about 25 cSt, and even more preferably about 2 cSt to about 8 cSt. Group V base oils useful in this disclosure preferably comprise an ester at a concentration of about 2% to about 20%, preferably from about 5% to about 15%.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. The above base stocks when used in combination with the additive components disclosed in this disclosure can be used to formulate SAE 0W-8, SAE 0W-12, SAE 0W-16, SAE 0W-20, SAE 0W-30, SAE 0W-40, SAE 5W-12, SAE 5W-16, SAE 5W-20, SAE 5W-30, and SAE 10W-40 products with exceptional LSPI performance. These base stocks when used in combination with the additive components disclosed in this disclosure are particularly effective in formulating SAE 0W-8, SAE 0W-12, SAE 0W-16, SAE 0W-20, SAE 0W-30, SAE 0W-40, and SAE 5W-30 oils with exceptional LSPI performance.

The base oil constitutes the major component of the engine oil lubricant composition of the present disclosure and typically is present in an amount ranging from about 50 to about 99 weight percent, preferably from about 70 to about 95 weight percent, and more preferably from about 85 to about 95 weight percent, based on the total weight of the composition. The base oil may be selected from any of the synthetic or natural oils typically used as crankcase lubricating oils for spark-ignited and compression-ignited engines. The base oil conveniently has a kinematic viscosity, according to ASTM standards, of about 2.5 cSt to about 12 cSt (or $mm^2/s$) at 100° C. and preferably of about 2.5 cSt to about 9 cSt (or $mm^2/s$) at 100° C., and more preferably of about 3.5 cSt to about 7 cSt (or $mm^2/s$) at 100° C. and even more preferred in some applications of 3.5 cSt to about 5 cSt (or $mm^2/s$) at 100° C. Mixtures of synthetic and natural base oils may be used if desired. Mixtures of Group III, IV, and V may be preferably used if desired.

Dispersants

During engine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash or little ash upon combustion. For example, non-metal-containing or borated metal-free dispersants are considered ashless. In contrast, metal-containing detergents discussed above form ash upon combustion.

At least one boron-containing compound is useful in this disclosure. The boron-containing compound comprises at least one borated dispersant, or a mixture of a boron-containing compound and a non-borated or a borated dispersant. Effective ranges of boron in the formulation from the borated dispersant or other boron containing additive(s) range from 30 ppm to 1500 ppm or more preferred range of from 60 ppm to 1000 ppm or most preferred range of from 120 ppm to 600 ppm.

Preferably, the boron-containing compound includes, for example, a borated succinimide, a borated succinate ester, a borated succinate ester amide, a borated Mannich base, and mixtures thereof.

The non-borated dispersant includes, for example, a hydrocarbyl succinic anhydride derived succinimide or succinate ester with a coupling agent, wherein the coupling agent comprises a boron-containing compound.

Preferably, boron is provided to the lubricating oil by a mixture of an organic or inorganic boron-containing compound and a borated succinimide, and/or boron-containing compound and a hydrocarbyl succinimide and/or a borated succinimide, a borated succinate ester, a borated succinate ester amide, a Mannich base ester, or mixtures thereof. The borated succinimide is preferably a mono succinimide, bis-succinimide, or a mixture thereof. Effective boron containing compounds include borated hydrocarbyl succinimides, including those derived for hydrocarbyl sources where number average molecular weight ($M_n$) is between 50 and 5000 Daltons, borated hydrocarbyl succinates, borated hydrocarbyl substituted Mannich bases, borated alcohols, borated alkoxylated alcohols, borated hydrocarbyl diols, borated hydrocarbyl amines, borated hydrocarbyl diamines, borated hydrocarbyl triamines, borated alkoxylated hydrocarbyl amines, borated alkoxylated hydrocarbyl amides, borated hydrocarbyl containing hydroxyl esters, borated hydrocarbyl substituted oxazolines, borated hydrocarbyl substituted imidazolones, and the like and mixtures of organic borates. Borates of —N—H, and/or —OH derived moieties can also be used. These borates can be inorganic, or organic moiety derived borates. Borates can be prepared using boric acid, borated alcohols and the like. These borates can be used at concentrations to provide 30 to 1500 ppm boron, 60-1200 ppm boron in the engine oil formulations, 60-240 ppm boron, 240-1200 ppm boron, 240-500 ppm boron, or 60-120 ppm boron to produce unexpected surprising improvement in LSPI performance, as desired.

The ratio of total zinc from the zinc-containing compound and antiwear agent plus total alkaline earth metal from the detergent divided by the total boron from the boron-containing compound and borated dispersant, in the lubricating oil, is from about 9.2 to 45, preferably from about 11 to 15.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms. In some exemplifications, the hydrocarbon chain can range from 6 to 50 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful, although on occasion, having a hydrocarbon substituent between 20-50 carbon atoms can be useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to ethylene amines (e.g., Diethylene triamine, triethylene tetraamine, tetraethylene pentaamine, hexaethylene heptamine, heptaethylene octaamine, and the like) Polyethylene amines containing Tetraethylene Pentaamine (TEPA) are often preferred. High molecular weight polyethylene amine bottoms comprising hexaethylene heptamine, and heptaethylene octaamine can also be used. The ratio of hydrocarbyl substituted succinic anhydride to polyethylene amines can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 Daltons or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or HN®$_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a $M_n$ of from about 500 to about 5000 Daltons, or from about 1000 to about 3000 Daltons, or about 1000 to about 2000 Daltons, or a mixture of such hydrocarbylene groups, often with high terminal vinylic groups. Preferred dispersants useful in this disclosure are characterized having a $M_n$ of about 800 to 1700 Daltons for low molecular weight, and a $M_n$ of about 1700 to about 5000 Daltons or greater for high molecular weight. Other preferred dispersants include succinic acid-esters and amides, alkylphenol-polyamine-coupled Mannich adducts, their capped derivatives, and other related components. Such additives may be used in an amount of about 0.1 to 20 weight percent, preferably about 0.5 to 8 weight percent, or more preferably 0.5 to 4 weight percent. The hydrocarbon portion of the dispersant atoms can range from $C_{60}$ to $C_{400}$, or from $C_{70}$ to $C_{300}$, or from $C_{70}$ to $C_{200}$. These dispersants may contain both neutral and basic nitrogen, and mixtures of both. The ratio of basic to non-basic nitrogen in the dispersant can range from 1 to 5, to 5 to 1 or more preferably from 1 to 2, to 2 to 1. Dispersants can be end-capped by borates and/or cyclic carbonates and or any carboxylic acid such as hydrocarbyl carboxylic acids or hydrocarbyl carboxylic acid anhydrides.

In accordance with this disclosure, an engine exhibits greater than about 50%, preferably greater than about 70%, and more preferably greater than about 80%, reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil containing a minor component other than the at least one boron-containing compound, and in an amount other than the amount of the at least one boron-containing compound, in the lubricating oil. Similar or even greater reduced low speed pre-ignition can be attained using mixtures of the at least one boron-containing compound with at least one detergent, preferably a magnesium containing detergent, and/or with at least one zinc-containing compound or at least one antiwear agent, as described herein.

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Detergents

Illustrative detergents useful in this disclosure include, for example, alkaline earth metal detergents, or mixtures of alkaline earth metal detergents. A typical alkaline earth metal detergent is an anionic material that contains a long chain hydrophobic portion of the molecule and a smaller anionic or oleophobic hydrophilic portion of the molecule. The anionic portion of the detergent is derived from an organic acid such as a sulfur acid, carboxylic acid, phosphorous acid, phenol, or mixtures thereof. The counterion is an alkaline earth metal. Preferably, the detergent comprises at least one alkaline earth metal salt of an organic acid, and the at least one alkaline earth metal salt of an organic acid comprises at least one magnesium salt of an organic acid.

Preferred detergents useful in the lubricating oils of this disclosure are selected from the group consisting of an alkaline earth metal sulfonate, an alkaline earth metal carboxylate (e.g., salicylate), an alkaline earth metal phenate, an alkaline earth metal phosphate, and mixtures thereof. The alkaline earth metal sulfonate, alkaline earth metal carboxylate, alkaline earth metal phenate, alkaline earth metal phosphate, and mixtures thereof, and the amount of the alkaline earth metal sulfonate, alkaline earth metal carboxylate, alkaline earth metal phenate, alkaline earth metal phosphate, and mixtures thereof in the lubricating oil, are sufficient for the engine to exhibit reduced low speed pre-ignition, as compared to low speed pre-ignition performance achieved in an engine using a lubricating oil containing a detergent other than the alkaline earth metal sulfonate, alkaline earth metal carboxylate, alkaline earth metal phenate, alkaline earth metal phosphate, and mixtures thereof, and in an amount other than the amount of the alkaline earth metal sulfonate, alkaline earth metal carboxylate, alkaline earth metal phenate, alkaline earth metal phosphate, and mixtures thereof, in the lubricating oil.

The alkaline earth metal detergents useful in this disclosure can be prepared by convention methods known in the art.

Alkaline earth metal sulfonates are a preferred class of detergents. Sulfur acids useful in preparing the alkaline earth metal sulfonates include sulfonic acids, thiosulfonic, sulfinic, sulfenic, partial ester sulfuric, sulfurous and thiosulfuric acids. Sulfonic acids are preferred.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing the alkaline earth metal sulfonate detergents useful in this disclosure. It is to be understood that such examples serve also to illustrate the alkaline earth metal salts of such sulfonic acids. In other words, for every sulfonic acid enumerated, it is intended that the corresponding basic alkaline earth metal salts thereof are also understood to be illustrated.

Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetra-isobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are useful in this disclosure. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents.

Preferred alkaline earth metal sulfonates include magnesium sulfonate, calcium sulfonate, and mixtures thereof.

Alkaline earth phenates are a useful class of detergents. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Preferred phenate compounds include, for example, magnesium phenate, calcium phenate, an overbased phenate compound, a sulfurized/carbonated calcium phenate compound, and mixtures thereof.

Alkaline earth metal salts of carboxylic acids are also useful as detergents. These carboxylic acid detergents may be prepared by reacting a basic alkaline earth metal compound with at least one carboxylic acid and removing free water from the reaction product. These compounds may be overbased to produce the desired TBN level.

Detergents made from salicylic acid are one preferred class of detergents derived from carboxylic acids. Useful salicylates include long chain alkyl salicylates. One useful family of compositions is of the formula

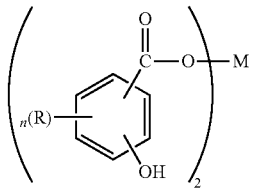

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium or magnesium.

Hydrocarbyl-substituted salicylic acids may be prepared from phenols by the Kolbe reaction (see U.S. Pat. No. 3,595,791). The alkaline earth metal salts of the hydrocarbyl-substituted salicylic acids may be prepared by double decomposition of an alkaline earth metal salt in a polar solvent such as water or alcohol.

Preferred carboxylate compounds comprise a noncarbonated magnesium salicylate (carboxylate); a carbonated magnesium salicylate (carboxylate); a noncarbonated calcium salicylate (carboxylate); a carbonated calcium salicylate (carboxylate); and mixtures thereof.

Salts that contain a substantially stoichiometric amount of the alkaline earth metal are described as neutral salts and have a total base number (TBN, as measured by ASTM D2896) of from 0 to 100. Many compositions are overbased, containing large amounts of a metal base that is achieved by reacting an excess of an alkaline earth metal compound with an acidic gas (such as carbon dioxide). Useful detergents can be neutral, mildly overbased, or highly overbased. These detergents can be used in mixtures of neutral, overbased, highly overbased magnesium salicylate, sulfonates, phenates and/or calcium salicylate, sulfonates, and phenates. The TBN ranges can vary from low TBN of about 0 to 100, medium TBN of about 100 to 200, and high TBN of about 200 to as high as 600. Mixtures of low, medium, high TBN can be used, along with mixtures of calcium and magnesium metal based detergents, and including sulfonates, phenates, salicylates, and carboxylates. Further examples of mixed TBN detergents can be found as described in U.S. Pat. No. 7,704,930, which is incorporated herein by reference. A detergent mixture with a metal ratio of 1, in conjunction of a detergent with a metal ratio of 2, and as high as a detergent with a metal ratio of 5 or 10 or 15, can be used. Borated detergents can also be used.

Alkaline earth metal phosphates may also be used as detergents and are known in the art.

Detergents may be simple detergents or what is known as hybrid or complex detergents. The latter detergents can provide the properties of two detergents without the need to blend separate materials. See U.S. Pat. No. 6,034,039.

Suitable detergents include magnesium sulfonates, calcium sulfonates, calcium phenates, magnesium phenates, calcium salicylates, magnesium salicylates, and other related components (including borated detergents), and mixtures thereof. Preferred detergents include magnesium sulfonate, calcium sulfonate, magnesium phenate, calcium phenate, magnesium salicylate, calcium salicylate, and mixtures thereof.

Other illustrative detergents that may be used in combination with the alkaline earth metal detergents include, for example, alkali metal detergents, or mixtures of alkali metal detergents.

In a detergent comprising a mixture of a magnesium salt of an organic acid and a calcium salt of an organic acid, the detergent ratio of magnesium metal to calcium metal ranges from about 1:0 to about 1:10, preferably from about 1:0 to about 1:4.

The magnesium and alkaline earth metal contributed by the detergent is present in the lubricating oil in an amount from about 500 ppm to about 5000 ppm, preferably from about 1000 ppm to about 2500 ppm. The magnesium contributed by the detergent is present in the lubricating oil in an amount from about 100 ppm to about 3000 ppm, preferably from about 300 ppm to about 2500 ppm, more preferably from about 750 ppm to about 2000 ppm.

The total base number (TBN), as measured by ASTM D2896, contributed by the detergent ranges from about 2 mg KOH/g to about 17 mg KOH/g, preferably from about 4 mg KOH/g to about 14 mg KOH/g. The TBN contributed by the magnesium detergent ranges from about 2 mg KOH/g to about 17 mg KOH/g, preferably from about 3 mg KOH/g to about 14 mg KOH/g, more preferably from about 5 mg KOH/g to about 10 mg KOH/g.

The sulfated ash contributed by the detergent ranges from about 0.4 to about 1.7 wt %, preferably from about 0.5 to about 1.6 wt %, and more preferably from about 0.6 to about 1.0 wt %. The sulfated ash contributed by the magnesium detergent ranges from about 0.3 to about 1.8 wt %, preferably from about 0.4 to about 1.6 wt %, and more preferably from about 0.6 to about 1.0 wt %. The lubricating engine oil of this disclosure preferably contains less than about 1.6 percent by weight sulfated ash and/or more preferably contains less than about 4000 ppm of magnesium. At higher engine oil sulfated ash at or above 1.2% ash (with the use of a magnesium detergent) greater than a 95% reduction in LSPI counts is achieved. At sulfated ash levels <1.2% with the use of a magnesium detergent, LSPI can be entirely eliminated.

For lubricating oil formulations containing at least one boron-containing compound and at least one detergent in accordance with this disclosure, an engine exhibits greater than about 50%, preferably greater than about 75%, and more preferably greater than about 95%, reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil containing a minor component other than the at least one boron-containing compound and at least one detergent, and in an amount other than the amount of the at least one boron-containing compound and at least one detergent, in the lubricating oil.

The detergent concentration in the lubricating oils of this disclosure can range from about 1.0 to about 6.0 weight percent, preferably about 2.0 to 5.0 weight percent, and more preferably from about 2.0 weight percent to about 4.0 weight percent, based on the total weight of the lubricating oil. In the lubricating oils of this disclosure, the amount of alkaline earth metal sulfonate preferably can range from about 0.5 to about 2.5 weight percent, preferably from about 0.5 to about 2.0 weight percent, and more preferably from about 0.5 to about 1.5 weight percent, based on the total weight of the lubricating oil. In the lubricating oils of this disclosure, the amount of alkaline earth metal phenate preferably can range from about 0.5 to about 2.5 weight percent, preferably from about 0.5 to about 2.0 weight percent, and more preferably from about 0.5 to about 1.5 weight percent, based on the total weight of the lubricating oil. In the lubricating oils of this disclosure, the amount of alkaline earth metal carboxylate can range from about 1.0 to about 4.0 weight percent, preferably from about 1.0 to about 3.0 weight percent, and more preferably from about 1.5 to about 2.5 weight percent, based on the total weight of the lubricating oil. In the lubricating oils of this disclosure, the amount of alkaline earth metal phosphate can range from about 1.0 to about 4.0 weight percent, preferably from about 1.0 to about 3.0 weight percent, and more preferably from about 1.5 to about 2.5 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 80 weight percent, or from about 40 weight percent to about 60 weight percent, of active detergent in the "as delivered" detergent product.

Antiwear Agent

A metal alkylthiophosphate and more particularly a metal dialkyl dithio phosphate in which the metal constituent is zinc, or zinc dialkyl dithio phosphate (ZDDP) is a useful component of the lubricating oils of this disclosure. ZDDP can be derived from primary alcohols, secondary alcohols or mixtures thereof. The preferred ZDDP compounds generally are represented by the formula $$Zn[SP(S)(OR^1)(OR^2)]_2$$

wherein $R^1$ and $R^2$ are independently primary or secondary $C_1$ to $C_8$ alkyl groups. A mixture of primary alcohol (1°)

derived ZDDP and secondary alcohol (2°) derived ZDDP can be used. The $R^1$ and $R^2$ substituents can independently be $C_1$-$C_{18}$ alkyl groups, preferably $C_2$-$C_{12}$ alkyl groups. Preferably, $R^1$ and $R^2$ are independently primary or secondary $C_1$ to $C_8$ alkyl groups, provided at least one of $R^1$ and $R^2$ is a secondary $C_1$ to $C_8$ alkyl group. Mixtures of primary alcohol derived ZDDP and secondary alcohol derived ZDDP, where $R^1$ and $R^2$ are $C_1$ to $C_8$ alkyl groups can be used. These alkyl groups may be straight chain or branched. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095", "LZ 1389" and "LZ 1371", from for example Chevron Oronite under the trade designation "OLOA 262" from for example Afton Chemical under the trade designation "HITEC 7169", and from for example Infineum under the trade designation Infineum C9417, and Infineum C9414.

Preferably, the primary or secondary $C_1$ to $C_8$ alkyl groups of the zinc dialkyl dithiophosphate compound are derived in part from an alcohol selected from the group consisting of: 2-propanol (C3), 1-butanol (n-C4), 1-isobutanol (1-i-C4), 2-butanol (2-C4), 1-pentanol (primary C-5), 3-methyl-1-butanol (primary C-5), 2-pentanol (i-C5), 3-pentanol (C5), 3-methyl-2-butanol (C5), 1-hexanol (primary C6), 4-methyl-1-pentanol (primary C6), 4-methyl-2-pentanol (i-C6), and 2-ethyl-1-hexanol (primary C8), and mixtures thereof. In some cases ZDDP derived from alcohols having an average carbon number of 5 and less are desirable. In some cases ZDDP derived from alcohols having an average carbon number of greater than 5 are desirable. Table 1 below shows alcohol mixtures used to make ZDDP which can be advantageously used in this invention.

TABLE 1

Alcohol Mixtures Useful in Preparing ZDDPs (wt %)

| i-C3, Secondary | 2-C4, - Secondary | 1-i-C4, Primary | n-C4, - Primary | i-C5 Secondary | n-C5 Primary | i-C6 Secondary | C6 Primary | C8 Primary |
|---|---|---|---|---|---|---|---|---|
| 20.2% | 4.0% | | | | | 75.7% | | |
| 8.4% | 3.2% | 11.7% | | | | | | 76.6% |
| 45.2% | 6.2% | 19.4% | 1.4% | 8.8% | 19.1% | | | |
| 42.3% | 2.4% | | | | | 55.3% | | |
| 23.2% | 13.3% | | | | | | | 63.6% |
| 5.7% | 2.3% | | | | | 92.1% | | |
| 4.6% | 63.1% | | | | | 32.3% | | |
| 4.1% | 2.4% | 52.6% | | | | | | 40.9% |
| 7.7% | 1.8% | | | | | | | 90.6% |
| 9.1% | | 0.4% | | | | 89.3% | 0.4% | 0.8% |
| 42.0% | | 0.5% | | | | 56.5% | 0.2% | 0.9% |
| 33.9% | | | | | | 66.1% | | |
| 0.3% | | 0.2% | | | | 99.6% | | |
| | 85.6% | | | | | | | 14.4% |

The $R^1$ and $R^2$ primary or secondary alkyl groups of the zinc dialkyl dithiophosphate compound, and the amount of the zinc dialkyl dithiophosphate compound having the $R^1$ and $R^2$ primary or secondary alkyl groups in the lubricating oil, are sufficient for an engine to exhibit reduced low speed pre-ignition, as compared to low speed pre-ignition performance achieved in an engine using a lubricating oil containing a minor component other than the particular zinc dialkyl dithiophosphate compound, and in an amount other than the amount of the particular zinc dialkyl dithiophosphate compound, in the lubricating oil.

In general, the ZDDP can be used in amounts of from about 0.4 weight percent to about 1.2 weight percent, preferably from about 0.5 weight percent to about 1.0 weight percent, and more preferably from about 0.6 weight percent to about 0.8 weight percent, based on the total weight of the lubricating oil, although more or less can often be used advantageously. Preferably, the ZDDP is a mixture of a primary alcohol derived ZDDP and, secondary alcohol derived ZDDP or a ZDDP derived from a mixture of primary alcohols and secondary alcohols, and present in an amount of from about 0.6 to 1.0 weight percent of the total weight of the lubricating oil.

Preferably, the zinc dialkyl dithiophosphate compounds having the $R^1$ and $R^2$ primary or secondary alkyl groups, in which the $R^1$ and $R^2$ primary or secondary alkyl groups are derived from 2-ethyl-1-hexanol (Primary C8), are present in an amount of from about 0.1 weight percent to about 5.0 weight percent, preferably from about 0.1 to about 1.2 weight percent, and more preferably from about 0.2 to about 0.8 weight percent, based on the total weight of the lubricating oil.

Preferably, the zinc dialkyl dithiophosphate compounds having the $R^1$ and $R^2$ primary or secondary alkyl groups, in which the $R^1$ and $R^2$ primary or secondary alkyl groups are derived from 4-methyl-2-pentanol (C6), are present in an amount of from about 0.1 weight percent to about 5.0 weight percent, preferably from about 0.1 to about 1.2 weight percent, and more preferably from about 0.2 to about 0.8 weight percent, based on the total weight of the lubricating oil.

Preferably, the zinc dialkyl dithiophosphate compound is derived from a $C_3$ to $C_8$ secondary alcohol, or a mixture thereof. Also, preferably, the zinc dialkyl dithiophosphate compound is derived from a mixture of a $C_1$ to $C_8$ primary alcohol and a $C_1$ to $C_8$ secondary alcohol.

The zinc content contributed by the zinc-containing compound or antiwear agent in the lubricating oil ranges from about 500 ppm to about 2000 ppm, preferably from about 600 ppm to about 900 ppm.

The phosphorus content contributed by the zinc-containing compound or antiwear agent in the lubricating oil ranges from about 400 ppm to about 2000 ppm, preferably from about 500 ppm to about 900 ppm. The phosphorus derived from the secondary ZDDP is preferably from 0 to 900 ppm and more preferably from 400 to 900 ppm.

The zinc to phosphorus ratio in the lubricating oil ranges from about 1.0 to about 2.0, preferably from about 1.05 to about 1.9.

The ratio of total metals provided by the detergent to total metals provided by the zinc-containing compound and antiwear agent is from about 0.8 to 4.8, preferably from about 1.4 to 4.0, and more preferably from about 1.5 to 3.7.

Illustrative zinc-containing compounds useful in this disclosure include, for example, zinc sulfonates, zinc carboxylates, zinc acetates, zinc napthenates, zinc alkenyl succinates, zinc acid phosphate salts, zinc phenates, zinc salicylates, and the like.

For lubricating oil formulations containing at least one boron-containing compound and the at least one zinc-containing compound or antiwear agent in accordance with this disclosure, an engine exhibits greater than about 20%, preferably greater than about 25%, and more preferably greater than about 30%, reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil containing a minor component other than the at least one boron-containing compound and the at least one zinc-containing compound or antiwear agent, and in an amount other than the amount of the at least one boron-containing compound and the at least one zinc-containing compound or antiwear agent, in the lubricating oil.

Also, for lubricating oil formulations containing at least one boron-containing compound, at least one detergent, and at least one zinc-containing compound or antiwear agent in accordance with this disclosure, an engine exhibits greater than about 50%, preferably greater than about 75%, and more preferably greater than about 95%, reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in an engine using a lubricating oil containing a minor component other than the at least one boron-containing compound, at least one detergent, and at least one zinc-containing compound or antiwear agent, and in an amount other than the amount of the at least one boron-containing compound, at least one detergent, and at least one zinc-containing compound or antiwear agent, in the lubricating oil.

Preferably, the zinc dialkyl dithiophosphate compounds having the $R^1$ and $R^2$ primary or secondary alkyl groups, in which the $R^1$ and $R^2$ primary or secondary alkyl groups are derived from 2-propanol (C3), 2-butanol (2-C4), 1-isobutanol (1-i-C4), or n-pentanol (n-C5), are present in an amount of from about 0.1 weight percent to about 5.0 weight percent, preferably from about 0.1 to about 1.2 weight percent, and more preferably from about 0.2 to about 0.8 weight percent, based on the total weight of the lubricating oil.

The zinc-containing compound or antiwear agent concentration in the lubricating oils of this disclosure can range from about 0.1 to about 5.0 weight percent, preferably about 0.2 to 2.0 weight percent, and more preferably from about 0.2 weight percent to about 1.0 weight percent, based on the total weight of the lubricating oil. In the presence of magnesium detergents and boron containing additives, only small amounts of ZDDP is needed to give exceptionally low LSPI counts. In such presence of magnesium and boron containing compounds as little as 0.1% to 1.0% ZDDP (100 ppm P to 1000 ppm P phosphorus in the formulated engine oil) will provide unexpected improvements in LSPI performance. At higher ash levels and higher TBN levels, ZDDP levels of 1.1 to 4.0% can provide unexpected improvements in LSPI performance. For SAE xW-40 and xW-50 oils (x=0, 5, 10, 15), ZDDP levels of 1.1 to 4.0% are especially useful to provide unexpected improvements in LSPI performance.

Other Additives

The formulated lubricating oil useful in the present disclosure may additionally contain one or more of the other commonly used lubricating oil performance additives including but not limited to other antiwear agents, other dispersants, other detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The types and quantities of performance additives used in combination with the instant disclosure in lubricant compositions are not limited by the examples shown herein as illustrations.

Viscosity Index Improvers

Viscosity index improvers (also known as VI improvers, viscosity modifiers, and viscosity improvers) can be included in the lubricant compositions of this disclosure.

Viscosity index improvers provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,500,000, more typically about 20,000 to 1,200,000, and even more typically between about 50,000 and 1,000,000.

Examples of suitable viscosity index improvers are linear or star-shaped polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers, are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Polyisoprene polymers are commercially available from Infineum International Limited, e.g. under the trade designation "SV200"; diene-styrene copolymers are commercially available from Infineum International Limited, e.g. under the trade designation "SV 260".

In an embodiment of this disclosure, the viscosity index improvers may be used in an amount of less than about 2.0 weight percent, preferably less than about 1.0 weight percent, and more preferably less than about 0.5 weight percent, based on the total weight of the formulated oil or lubricating engine oil. Viscosity improvers are typically added as concentrates, in large amounts of diluent oil.

In another embodiment of this disclosure, the viscosity index improvers may be used in an amount of from 0.25 to about 2.0 weight percent, preferably 0.15 to about 1.0 weight percent, and more preferably 0.05 to about 0.5 weight percent, based on the total weight of the formulated oil or lubricating engine oil.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic propionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of 0.01 to 5 weight percent, preferably 0.01 to 2 weight percent, more preferably zero to 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, alkoxysulfolanes, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 2 below.

It is noted that many of the additives are shipped from the additive manufacturer as a concentrate, containing one or more additives together, with a certain amount of base oil diluents. Accordingly, the weight amounts in the table below, as well as other amounts mentioned herein, are directed to the amount of active ingredient (that is the non-diluent portion of the ingredient). The weight percent (wt %) indicated below is based on the total weight of the lubricating oil composition.

TABLE 2

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |
| Anti-foam Agent | 0.001-3 | 0.001-0.15 |
| Viscosity Index Improver (solid polymer basis) | 0.1-2 | 0.1-1 |
| Anti-wear | 0.1-2 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

Formulated engine oils of the instant disclosure exhibit substantial elimination of LSPI. Substantial elimination of LSPI means greater than about 95%, or greater than about 97%, or greater than about 99% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar.

Formulated engine oils with higher ash levels of 1.2 to 1.6% or more in conjunction with the other components disclosed in this disclosure can significantly reduce the number of LSPI events by 96% or more. Formulated engine oils with lower ash levels of 0.2 to 1.2% in conjunction with the other components disclosed in this disclosure can reduce the number of LSPI events entirely.

Engines that are highly susceptible to Low speed pre-ignition (LSPI) are those which operate at high brake mean effective pressure (BMEP) and low engine speed (RPM). This includes internal combustion engines using a variety of fuels, including natural gas, gasoline, diesel, biofuels, and the like. Downsized, downspeeded, forced-induction (e.g., Turbocharged) engines are most susceptible to operating under these engine conditions and are thus more susceptible to LSPI. Non-limiting examples of engines possessing these characteristics include the GM Ecotec and Ford EcoBoost family of engines as well as other high BMEP (capable of >10 bar) engines with displacements ranging from about 1 L to about 6 L as well as engines possessing between 2-10 combustion cylinders in geometric configurations including inline, flat (Boxer), and "V" (e.g., "V8", "in-line 3", "in-line 4", "flat 4" etc.). Furthermore the calibration and operational setpoints of the engine may significantly influence both the frequency and severity of LSPI events.

ASTM D6335. This is a measure of the cleanliness performance of the engine oil with lower values yielding improved cleanliness performance.

Two test methods used for measuring low speed pre-ignition were the Ford LSPI test and the GM LSPI test. The test methods for each are as follows.

The Ford LSPI test is a fired engine dynamometer test which uses a 2.0 L Ford EcoBoost, spark ignition, four stroke, in-line 4-cylinder gasoline turbocharged direct injection (GTDI) engine as the test apparatus. The engine uses a dual overhead cam, four valves per cylinder (2 intake; 2 exhaust), and direct acting mechanical bucket lifter valve train design. A test cycle consists of operating the engine at 1750 rpm with a torque of 269 Nm for 175,000 cycles. This test sequence is repeated 4 times for a complete test. The engine is monitored for pre-ignition events and the total number of pre-ignition events are tabulated.

Lower values provide for improved LSPI performance. Each iteration is as outlined in the Table 3 below:

TABLE 3

| | | Iteration | | | |
|---|---|---|---|---|---|
| Parameters | Units | A | B | C | D |
| Duration | cycles | 175000 | 175000 | 175000 | 175000 |
| Engine Speed | r/min | 1750 | 1750 | 1750 | 1750 |
| Torque | Nm | 269 | 269 | 269 | 269 |
| Equivalence Ratio | λ | 1.00 | 1.00 | 1.00 | 1.00 |
| Coolant Out Temperature | ° C. | 95 | 95 | 95 | 95 |
| Oil Gallery Temperature | ° C. | 95 | 95 | 95 | 95 |
| Inlet Air Temperature | ° C. | 30 | 30 | 30 | 30 |
| Air Charge Temperature | ° C. | 43 | 43 | 43 | 43 |
| Fuel Temperature | ° C. | 30 | 30 | 30 | 30 |
| Inlet Air Pressure | kPa | 0.05 | 0.0.5 | 0.05 | 0.05 |
| Exhaust Back Pressure | kPaA | 104 | 104 | 104 | 104 |

The GM LSPI test is an engine dynamometer which uses a GM, spark ignition, four stroke, 4-cylinder gasoline turbocharged direct injection (GTDI) engine. A cyclic operating cycle shown below in Table 4 is used for a test cycle. A total of 3 test cycles comprises a complete test. LSPI is measured by determining how many peak pressure pre-ignition events occur during the 3 cycle test. Again with this test, lower values provide for improved LSPI performance.

TABLE 4

| | | Stages* | | | | | | | | |
|---|---|---|---|---|---|---|---|---|---|---|
| Parameters | Units | 0.1 | 1 | 2 | 3 | 4 | 5 | 6 | 7 | 8 |
| Duration | sec | 1800 | 600 | 300 | 900 | 300 | 900 | 300 | 900 | 300 |
| Engine Speed | r/min | 2000 | 3900 | 2000 | 2000 | 2000 | 2000 | 2000 | 2000 | 2000 |
| Torque | Nm | 100 | 200 | 32 | 350 | 32 | 350 | 32 | 350 | 32 |
| Coolant Out Temperature | ° C. | | | | 95 | | 95 | | 95 | |
| Oil Sump Temperature | ° C. | | | | 100 | | 100 | | 100 | |
| Intake Manifold Post-Intercooler Temp | ° C. | | | | 32 | | 31 | | 31 | |
| Exhaust Back Pressure | kPa | | | | 5.0 | | 5.0 | | 5.0 | |
| Humidity Dew Point | ° C. | 7.0 | 7.0 | 7.0 | 7.0 | 7.0 | 7.0 | 7.0 | 7.0 | 7.0 |
| Equivalence Ratio | λ | 1.00 | 1.00 | 1.00 | 1.00 | 1.00 | 1.00 | 1.00 | 1.00 | 1.00 |

The following non-limiting examples are provided to illustrate the disclosure.

EXAMPLES

Test Methods

Piston or rod deposit formation of the lubricating engine oil formulations was measured using a thermo-oxidation engine oil simulation test (TEOST 33C) test as measured by

Example A

Formulations were prepared as described in FIG. 1. All of the ingredients used herein are commercially available. Group III, IV and V base stocks were used in the formulations. The dispersants used in the formulations were a borated succinimide (which comprised a borated polyisobutenyl succinimede with a B/N ratio equal to about 0.5), a high molecular weight succinimide (High MW Succinimide Dispersant 1 which comprised an ethylene carbonate-capped bis-polyisobutenyl succinimide dispersant with about 1% total nitrogen) and a high molecular weight succinimide (High MW Succinimide Dispersant 2 which comprised a bis-polyisobutenyl succinimide with about 1.2% total nitrogen).

The remaining ingredients used in the formulations were one or more of a viscosity index improver, antioxidant, dispersant, anti-wear agent, pour point depressant, corrosion inhibitor, metal deactivator, seal compatibility additive, anti-foam agent, inhibitor, anti-rust additive, and friction modifier.

Testing was conducted for formulations described in FIG. 1. The results are set forth in FIG. 1. Sulfated ash testing was determined in accordance with ASTM D874. Boron content was determined in accordance with ASTM D6443. Nitrogen content was determined in accordance with ASTM D3228.

Different engine hardware and control schemes can significantly influence the occurrence of LSPI. See, for example, U.S. Patent Application Publication Nos. 2012/1866225 and 2003/0908070, and also SAE 2012-02-1148, SAE 2011-01-0340, and SAE 2011-01-0343, which are all incorporated herein by reference. Furthermore, FIG. 13 shows drive cycle data obtained from a taxi cab field trial. Two different 2.0 L L4 TGDI engine types, from different Original Equipment Manufacturers were driven in a typical taxi cab city drive cycle for 2 weeks. Engine performance data was collected using the vehicles' OBD-II data ports and mapped onto the published engine torque maps for the respective engines. As published in SAE 2011-01-0339, engines are specifically prone to LSPI when they operate in a region above 10 bar BMEP and below 3000 rpm engine speed. Therefore, any region of the torque maps for these engines which is bounded by these operating conditions is potentially prone to LSPI. Based on the measured data for the OBD-II data loggers, it can be shown that engines with different calibrations can exhibit different LSPI behavior based on how they are tuned. FIG. 13 shows approximately 1.2 million data points summarizing the operation of two different engine types in atypical taxi cab city driving cycle over a 2 week period. Several taxi cabs using each engine type were observed in this manner. Engine Make 1 spends on average 1.67% of its operating time in the LSPI "danger zone" while Engine Make 2 only spends on average 0.17% in a typical taxi cab city drive cycle, even though both engines are 2.0 L inline 4-cylinder TGDI engines. Furthermore, Engine Make 2 has exhibited zero LSPI related field failures, while Engine Make 1 has exhibited multiple failures related to LSPI. This further illustrates the different responsiveness of different engine platforms to LSPI.

For the purposes of this disclosure, a 2.0 L, 4-cylinder TGDI GM Ecotec engine was used for LSPI testing. A six segment test procedure was used to determine the number of LSPI events that occurred at two different specified engine load and speed conditions. Each segment of the test procedure comprised 25,000 engine cycles, where one cycle corresponds to 720 degrees of crank shaft rotation. The first set of conditions was 2000 RPM and 18 bar BMEP, hereafter referred to as "High Load". The second set of conditions was 1500 RPM and 12.5 bar BMEP, hereafter referred to as "Low Load". The test procedure comprised two segments of High Load, followed by two segments of Low Load, followed by two segments of High Load. A 30 minute warm up at 2000 RPM and 4 bar BMEP was also conducted prior to commencing the test procedure. This test procedure was repeated four times for each of the lubricants tested. LSPI events were counted during the High Load segments only, using pressure transducers placed in each of the 4 cylinders to monitor the peak cylinder pressure. Peak pressures in the cylinder that were greater than 4.7 standard deviations above the mean peak cylinder pressure, or more than 4.7 standard deviations below the mean peak cylinder pressure were counted as an LSPI event. The results of such LSPI testing are set forth in FIG. 1.

The testing evaluated the impact of dispersant chemistry on LSPI. As shown in FIG. 1, the amount of boron in a formulation has a strong correlation with the total number of LSPI counts for that oil. Specifically, as the boron ppm increases from 0, to 241, to 507, the LSPI counts surprisingly decrease from about 43, to 27, to 24. This is a reduction of 40% with only about 241 ppm of boron and a reduction of 48% with about 507 ppm of boron. While the relative change in LSPI count going from 0 ppm to 241 ppm is larger than the relative change in LSPI count going from 241 ppm to 507 ppm boron, the directional unexpected benefit of boron is still maintained. Even a boron boost of about 240 ppm reduced LSPI count by an unexpected 40%. A boron source, providing 0 to about 1000 ppm of boron, more preferably 0 to about 500 ppm, is thus beneficial to the reduction of LSPI. Additionally, comparing Comparative Example 5 with Example 2 and Example 11 further demonstrates the utility of borated dispersants to mitigate the negative impacts of other dispersant types. Comparative Example 5 and Example 2 showed approximately equal LSPI event counts of 22 and 24 events respectively, while Example 2 contained only a Borated Succinimide dispersant and Comparative Example 5 contained no dispersants. Furthermore, Comparing Examples 1 and 11 with Comparative Examples 1 and 2, showed that Borated dispersants significantly reduce LSPI event counts that are observed for lubricants containing non-borated dispersants alone, even at very high levels of dispersant derived Nitrogen.

The dispersants used in the testing were further evaluated using thermogravimetric analysis techniques (TGA). A TA instruments Q5000 TGA was used with a platinum reference pan. Nitrogen gas was passed over the sample at 60.0 milliliters per minute. Approximately 15 mg of the sample dispersant was used in the analysis, and subjected to the following temperature ramp program: equilibration at 50° C., followed by a temperature ramp to 650° C. over about 1 minute, equilibration at 650° C., followed by an isothermal soak at 650° C. for approximately 15 seconds. The gas was then switched to oxygen, flowing at 60.0 milliliters per minute with a further isothermal soak at 650° C. for an additional 45 seconds. Finally, the temperature was ramped from 650° C. to 750° C. over about 30 seconds, and isothermally soaked at 750° C. for an additional 30 seconds.

The results are shown in FIG. 2 and indicate that as the temperature at which 20% and/or 50% weight loss is achieved in a TGA measurement increases the LSPI count decreases. The three traces on the TGA plot represent the three dispersant types used in this analysis. Specifically, Dispersant 1 represents High MW Succinimide Dispersant 1, Dispersant 2 represents High MW Succinimide Dispersant 2, and Dispersant 3 represents the Borated Succinimide Dispersant. The 20% weight loss achieved temperatures for these dispersants are about 355° C., 344° C., and 328° C., respectively. The 50% weight loss achieved temperatures for these dispersants are about 406° C., 400° C., and 377° C., respectively. Surprisingly, the borated succinimide dispersant which showed a lower LSPI count, yielded a TGA temperature at 20% and 50% weight loss which was higher than the non-borated succinimide dispersants which showed a higher LSPI count.

Example B

Formulations were prepared as described in FIG. 3. All of the ingredients used herein are commercially available. Group III, IV and V base stocks were used in the formulations.

The detergents used in the formulations were a medium TBN calcium alkyl salicylate (Calcium Salicylate 1 which contains 7.3% Ca and has a TBN of about 200), a low TBN calcium alkyl salicylate (Calcium Salicylate 2 which contains 2.3% Ca and about 65 TBN), a high TBN calcium alkyl sulfonate (Calcium Sulfonate 1 which contains 11.6% Ca and about 300 TBN), a low TBN calcium alkyl sulfonate (Calcium Sulfonate 2 which contains 2.0% Ca and about 8 TBN), and a high TBN magnesium alkyl sulfonate (Magnesium Sulfonate 1 which contains 9.1% Mg and about 400 TBN). The TBN ranges are defined as: low TBN of about 0 to 100, medium TBN of about 100 to 200, and high TBN of about 200 to as high as 600.

The dispersants used in the formulations were a borated succinimide, a high molecular weight succinimide (High MW Succinimide Dispersant 1) and a high molecular weight succinimide (High MW Succinimide Dispersant 2).

The remaining ingredients used in the formulations were one or more of a viscosity index improver, antioxidant, dispersant, anti-wear agent, pour point depressant, corrosion inhibitor, metal deactivator, seal compatibility additive, anti-foam agent, inhibitor, anti-rust additive, and friction modifier.

Testing was conducted for formulations described in FIG. 3. The results are set forth in FIG. 4. Sulfated ash testing was determined in accordance with ASTM D874. Boron, calcium and magnesium content were determined in accordance with ASTM D6443. Nitrogen content was determined in accordance with ASTM D3228. LSPI testing was conducted for formulations in accordance with the procedures described in Example 1 using the 2.0 L, 4-cylinder TGDI GM Ecotec engine.

The testing evaluated the impact of magnesium detergents and borated dispersants on LSPI. As shown in FIG. 4, the use of a borated dispersant along with a magnesium sulfonate detergent is found to be unexpectedly beneficial for LSPI performance. Comparative Examples 1 and 2, and Example 2 reiterate the novel findings identified in Example A with regard to the benefits of using a boron source to significantly mitigate or reduce LSPI. Examples 4 and 5, which are both formulated using a magnesium sulfonate detergent and a boron source, demonstrate excellent LSPI performance at different levels of sulfated ash. As sulfated ash is known to be detrimental to LSPI performance, the fact that doubling the sulfated ash going from 0.8 weight percent to 1.6 weight percent unexpectedly leads to a very minimal increase in LSPI count, from 0 to 2, reiterates the novel findings represented by these blends, even at extremely high ash level. Examples 4 and 5 show LSPI reductions of 100% and 95%, respectively.

Example C

Formulations were prepared as described in FIG. 5. All of the ingredients used herein are commercially available. Group III, IV and V base stocks were used in the formulations.

The detergents used in the formulations were a medium TBN calcium alkyl salicylate (Calcium Salicylate 1 which contains 7.3% Ca and has a TBN of about 200), a low TBN calcium alkyl salicylate, (Calcium Salicylate 2 which contains 2.3% Ca and about 65 TBN), a high TBN calcium alkyl sulfonate (Calcium Sulfonate 1 which contains 11.6% Ca and about 300 TBN), a low TBN calcium alkyl sulfonate (Calcium Sulfonate 2 which contains 2.0% Ca and about 8 TBN), a medium TBN calcium alkyl phenate (Calcium Phenate 1 which contains 5.5% Ca and about 150 TBN), and a high TBN magnesium alkyl sulfonate (Magnesium Sulfonate 1 which contains 9.1% Mg and about 400 TBN). The TBN ranges are defined as: low TBN of about 0 to 100, medium TBN of about 100 to 200, and high TBN of about 200 to as high as 600.

The dispersants used in the formulations were a borated succinimide and a high molecular weight succinimide. The antiwear agents used in the formulations were ZDDP derived from a secondary alcohol (which contained 10% by weight Phosphorus and was prepared from mixed C3 and C6 secondary alcohols) and ZDDP derived from a primary alcohol (which contained 7% by weight Phosphorus and was prepared from C8 primary alcohols).

The remaining ingredients used in the formulations were one or more of a viscosity index improver, antioxidant, dispersant, anti-wear agent, pour point depressant, corrosion inhibitor, metal deactivator, seal compatibility additive, anti-foam agent, inhibitor, anti-rust additive, and friction modifier.

Testing was conducted for formulations described in FIG. 5. The results are set forth in FIG. 6. Sulfated ash testing was determined in accordance with ASTM D874. Calcium, magnesium, boron, zinc and phosphorus content were determined in accordance with ASTM D6443. Nitrogen content was determined in accordance with ASTM D3228. LSPI testing was conducted for formulations in accordance with the procedures described in Example 1 using the 2.0 L, 4-cylinder TGDI GM Ecotec engine. The testing evaluated the impact of a three additive system (i.e., detergent, dispersant and antiwear agent) on LSPI. As shown in FIG. 6, where LSPI is measured for formulations containing a non-borated dispersant and for formulations containing a mixture of non-borated dispersant and borated dispersant, the use of a borated succinimide dispersant has unique LSPI benefits over high molecular weight succinimide dispersant. Comparative Example 3, Example 6 and Example 10 show the impact of increasing boron content on LSPI performance. As the boron content increases from 0, to 240, and to 507 ppm, the LSPI count decreases from 46, to 27, and to 24. The benefit of boron in reducing LSPI frequency represents a significant and unexpected finding presented in FIGS. 5 and 6. Example 8 and Example 9 showcase the unique combination of a magnesium sulfonate detergent with a dual dispersant system and a secondary alcohol derived ZDDP. The dual dispersant system contains a boron source. The uniqueness of this combination is shown by comparing to Comparative Example 3, which uses a different calcium salicylate based detergent system and has the highest LSPI counts. The use of magnesium sulfonate detergent, with a secondary alcohol derived ZDDP, and a borated dispersant is shown to significantly reduce, if not eliminate, LSPI. The desirable ratio of the total concentration of $([Mg]+[Ca]+[Zn]+[P])/([B]+[N]_{dispersant})$ is about 2.5 to 7, more preferably from about 3.3 to 5. Comparing Example 6 with Example 12 further demonstrates the utility of this approach of incorporating a borated dispersant with a secondary alcohol derived ZDDP and a combination of a magnesium sulfonate detergent with a calcium salicylate detergent. Example 12 shows a reduction in LSPI by 98% compared to Comparative Example 3.

Example D

The lubricating engine oil formulations in FIGS. 7 and 8 are combinations of additives and base stocks and are anticipated to have kinematic viscosity at 100° C. around 7.5-8.5 cSt and high temperature high shear ($10^{-6}$ $s^{-1}$) viscosity at 150° C. around 2.5 to 2.9 cP. The lubricating engine oil formulations of Examples P1, P2, P3 are expected to have boron to dispersant nitrogen ratios of 0.05, 0.15, and 0.51, respectively. The total boron content in these formulations is expected to range from 50 ppm to 800 ppm. The (Mg+Ca)/(B+Ndisp) ratio is expected to range from 1.28 for Example P3 to 2.91 for Example P1. Similarly, the ([Zn]+[P])/([B]+$[N]_{dispersant}$) ratio is expected to range from 0.71 for Example P3 and 1.62 for Example P1. Finally, the ([Mg]+[Ca]+[Zn]+[P])/([B]+$[N]_{dispersant}$) ratio of Examples P1, P2 and P3, is expected to be between 1.99 and 4.53. The lubricating engine oil formulations of Examples P4 and P5 are expected to have magnesium content of 300 ppm to 600 ppm. Similarly the lubricating engine oil formulations of Examples P6, P7, and P8 are expected to have magnesium content of about 300 ppm to 900 ppm and a magnesium to calcium ratio of about 0.12 for Example P6 to 1.21 for Example P8. At the same time, the TBN of these examples is varying from 6.8 for Examples P8, to P9 for Example P6. Similarly the sulfated ash content in Example P4, P5, and P6 is varying from 0.3 wt % to 1.2 wt % ash. The other ratios identified in FIGS. 7 and 8 are also changing as indicated therein. The lubricating engine oil formulations of Examples P9 and P10 are expected to have magnesium to calcium ratio of about 0.06 and 3, respectively, at a constant TBN. The lubricating engine oil formulations of Examples P11, P12 and P13 are expected to have zinc content ranging from about 96 ppm for Example P13 to about 635 ppm for Example P11. The lubricating engine oil formulations of Examples P11, P12 and P13 are expected to have phosphorus content ranging from about 87 ppm for Example P13 to about 570 ppm for Example P11. The ([Mg]+[Ca])/([Zn]+[P]) ratio ranges from about 2.5 for Example P11 to 16.5 for Example P13. The ([Zn]+[P])/([B]+$[N]_{dispersant}$) ratio ranges from about 1 for Example P11 to 0.15 for Example P13. The ([Mg]+[Ca]+[Zn]+[P])/([B]+$[N]_{dispersant}$) ratio ranges from about 3.4 for Example P11 to 2.6 for Example P13.

Example E

The lubricating engine oil formulations in FIGS. 9 and 10 are combinations of additives and base stocks and are anticipated to have kinematic viscosity at 100° C. around 5.5-7.5 cSt and high temperature high shear ($10^{-6}$ $s^{-1}$) viscosity at 150° C. around 2 to 2.5 cP. The lubricating engine oil formulations of Examples P14, P15 and P16 are expected to have boron to dispersant nitrogen ratios of 0.05, 0.15, and 0.51, respectively. The total boron content in these formulations is expected to range from 50 ppm to 800 ppm. The ([Mg]+[Ca])/([B]+$[N]_{dispersant}$) ratio is expected to range from 1.28 for Example P16 to 2.91 for Example P14. Similarly, the ([Zn]+[P])/([B]+$[N]_{dispersant}$) ratio is expected to range from 0.71 for Example P16 and 1.62 for Example P14. Finally, the ([Mg]+[Ca]+[Zn]+[P])/([B]+$[N]_{dispersant}$) ratio of Examples P14, P15 and P16, is expected to be between 1.99 and 4.53. The lubricating engine oil formulations of Examples P17 and P18 are expected to have magnesium content of 300 ppm to 600 ppm. Similarly the lubricating engine oil formulations of Examples P19, P20, and P21 are expected to have magnesium content of about 300 ppm to 900 ppm and a magnesium to calcium ratio of about 0.12 for Example P19 to 1.21 for Example P21. At the same time, the TBN of these examples is varying from 6.8 for Example P21, to 9 for Example P19. Similarly the sulfated ash content in Example P17, P18, and P19 is varying from 0.3 wt % to 1.2 wt % ash. The other ratios identified in FIGS. 9 and 10 are also changing as indicated therein. The lubricating engine oil formulations of Examples P22 and P23 are expected to have magnesium to calcium ratio of about 0.06 and 3, respectively, at a constant TBN. The lubricating engine oil formulations of Examples P24, P25, and P26 are expected to have zinc content ranging from about 96 ppm for Example P26 to about 635 ppm for Example P24. The lubricating engine oil formulations of Examples P24, P25, and P26 are expected to have phosphorus content ranging from about 87 ppm for Example P26 to about 570 ppm for Example P24. The ([Mg]+[Ca])/([Zn]+[P]) ratio ranges from about 2.5 for Example P24 to 16.5 for Example P26. The ([Zn]+[P])/([B]+$[N]_{dispersant}$) ratio ranges from about 1 for Example P24 to 0.15 for Example P26. The ([Mg]+[Ca]+[Zn]+[P])/([B]+$[N]_{dispersant}$) ratio ranges from about 3.4 for Example P24 to 2.6 for Example P26.

Example F

The lubricating engine oil formulations in FIGS. 11 and 12 are combinations of additives and base stocks and are anticipated to have kinematic viscosity at 100° C. around 9-11 cSt and high temperature high shear ($10^{-6}$ $s^{-1}$) viscosity at 150° C. around 2.9 to 3.4 cP. The lubricating engine oil formulations of Examples P27, P28, and P29 are expected to have boron to dispersant nitrogen ratios of 0.05, 0.15, and 0.51, respectively. The total boron content in these formulations is expected to range from 50 ppm to 800 ppm. The ([Mg]+[Ca])/([B]+$[N]_{dispersant}$) ratio is expected to range from 1.28 for Example P29 to 2.91 for Example P27. Similarly, the ([Zn]+[P])/([B]+[N]dispersants) ratio is expected to range from 0.71 for Example P29 and 1.62 for Example P27. Finally, the ([Mg]+[Ca]+[Zn]+[P])/([B]+$[N]_{dispersant}$) ratio of Examples P27, P28, and P29, is expected to be between 1.99 and 4.53. The lubricating engine oil formulations of Examples P30 and P31 are expected to have magnesium content of 300 ppm to 600 ppm. Similarly the lubricating engine oil formulations of Examples P32, P33, and P34 are expected to have magnesium content of about 300 ppm to 900 ppm and magnesium to calcium ratio of about 0.12 for Example P32 to 1.21 for Example P34. At the same time, the TBN of these examples is varying from 6.8 for Example P34, to 9 for Example P32. Similarly the sulfated ash content in Example P30, P31, P32 is varying from 0.3 wt % to 1.2 wt % ash. The other ratios identified in FIGS. 11 and 12 are also changing as indicated therein. The lubricating engine oil formulations of Examples P35 and P36 are expected to have magnesium to calcium ratio of about 0.06 and 3, respectively, at a constant TBN. The lubricating engine oil formulations of Examples P37, P38, and P39 are expected to have zinc content ranging from about 96 ppm for Example P39 to about 635 ppm for Example P37. The lubricating engine oil formulations of Examples P37, P38, and P39 are expected to have phosphorus content ranging from about 87 ppm for Example P39 to about 570 ppm for Example P37. The ([Mg]+[Ca])/([Zn]+[P]) ratio ranges from about 2.5 for Example P37 to 16.5 for Example P39. The ([Zn]+[P])/([B]+$[N]_{dispersant}$) ratio ranges from about 1 for Example P37 to 0.15 for Example P39. The ([Mg]+[Ca]+[Zn]+[P])/([B]+[N]$_{dispersant}$) ratio ranges from about 3.4 for Example P37 to 2.6 for Example P39. The concentrations of metal used in the preceding examples are in units of total % by weight in the finished lubricant. [N]$_{dispersant}$ refers to the nitrogen concentration contributed to the finished lubricant by the dispersants only.

Example G

Lubricating engine oil formulations were prepared according to FIG. 14 using the components shown in Table 5 below.

TABLE 5

| Component Key | |
|---|---|
| Group III 1, wt % | hydroisomerized base stocks |
| Group III 2, wt % | hydroisomerized base stocks |
| Group III 3, wt % | hydroprocessed or hydrocracked base stocks |
| Group IV 1, wt % | polymerized and interpolymerized olefins |
| Group V 1, wt % | ester containing from about 5 to about 10 or more carbon atoms |
| Viscosity Index Improver 1 | Hydrogenated isoprene star VM having a Mw of 936,000 as determined by light scattering and a polydispersity index of 1.7 |
| Viscosity Index Improver 2 | Hydrogenated isoprene star VM having a Mw of 567,200 as determined by light scattering and a polydispersity index of 1.6 |
| Viscosity Index Improver 3 | Solid styrene-isoprene block copolymer; Mw~106 k, Mn~104 k. 33% styrene |
| Borated Succinimide Dispersant, wt % | PIBSA/PAM borated dispersant. Typical TBN 26 mgKOH/g. Typical N content is 1.7% and typical B content is 0.87%. |
| Borated Succinimide Dispersant, wt % | PIBSA/PAM borated dispersant with a typical B content of 2.3% and typical N content of 1.19%. |
| High MW Succinimide Dispersant 1, wt % | PIBSA/PAM dispersant, capped with ethylene carbonate. Typical N content is 1%. |
| High MW Succinimide Dispersant 2, wt % | Polyisobutenyl bis-succinimide (PIB 2300-2500 Mn). Typical TBN 28 mgKOH/g. Typcial N content of 1.2%. |
| High MW Succinimide Dispersant 3, wt % | PIBSA/PAM dispersant. Typical N content is 1.43%. |
| Ca salicylate 1 | mixture of calcium salicylates averaging ~200 TBN |
| Ca salicylate 2 | mixture of calcium salicylates averaging ~70 TBN |
| Ca sulfonate 1 | mixture of calcium sulfonates averaging ~300 TBN |
| Ca sulfonate 2 | mixture of calcium sulfonates averaging ~10 TBN |
| Ca phenate | sulfurized calcium phenate averaging ~150 TBN |
| Rest of Formulation (any combination of the following additives) | organic and molybdenum-containing friction modifiers, phenolic antioxidant, aminic antioxidant, antifoam, pour point depressant, secondary ZDDP |

The LSPI (Ford and GM tests) and cleanliness performance (TEOST 33C) of the comparative and inventive lubricating engine oil formulations were measured and are also shown in FIG. 14. The results show that decreasing the boron to nitrogen ratio (B:N ratio in the range of 0 to 0.3) in the inventive engine oil formulations provide for a combination of acceptable LSPI performance (Ford test less than or equal to 21 counts and GM test less than or equal to 3 events) and acceptable cleanliness (TEOST 33C deposits less than or equal to 34 mg.), which was surprising and unexpected. In contrast, the comparative engine oil formulations with B:N ratio in the range of 0.5 to 1.0 had poor cleanliness performance (TEOST 33C deposits greater than or equal to 52 mg.).

Example H

Lubricating engine oil formulations were prepared according to FIG. 15 using the components shown in Table 5 above. The LSPI (Ford and GM tests) of the comparative and inventive lubricating engine oil formulations were measured and are also shown in FIG. 15. For all of the formulations, the B:N ratio was 0. The results show that decreasing the dispersant nitrogen concentration below 700 ppm resulted in a significant improvement in LSPI performance for both the Ford and GM tests, which was surprising and unexpected.

Example I

Lubricating engine oil formulations with high calcium detergent levels were prepared according to FIG. 16 using the components shown in Table 5 above. The LSPI (Ford and GM tests) of the comparative and inventive lubricating engine oil formulations were measured and are also shown in FIG. 16. The comparative formulations had B:N ratios of 0, whereas the inventive formulations had B:N ratios of 0.1 to 0.2. The results show that the addition of low levels of boron to the engine oil (<300 ppm and a B:N ratio of <0.3) improves LSPI performance for both the Ford and GM tests independent of the calcium detergent ligand type (salicylate, sulfonate, phenate), which was surprising and unexpected.

PCT and EP Clauses:

1. A method for preventing or reducing low speed pre-ignition in a spark ignited internal combustion engine lubricated with a lubricating oil while maintaining or improving deposit control comprising the steps of:

lubricating a spark ignited internal combustion engine with a lubricating oil comprising a lubricating oil base stock as a major component; and at least one boron-containing compound and at least one overbased calcium detergent, as minor components; wherein said at least one boron-containing compound comprises at least one borated dispersant, or a mixture of a boron-containing compound and a non-borated dispersant, wherein the boron to nitrogen ratio for the at least one boron-containing compound is less than or equal to about 0.3 with the proviso that the lubricating oil is essentially free of elemental magnesium; and measuring the deposit control of the lubricating oil and the low speed pre-ignition of the spark ignited internal combustion engine lubricated with the lubricating oil;

wherein the spark ignited internal combustion engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in a spark ignited internal combustion engine using a lubricating oil that does not comprise the at least one boron-containing compound and the at least one overbased calcium detergent, and wherein the deposit control is maintained or improved (TEOST 33C total deposits less than or equal to 34 mg) as compared to deposit control achieved using a lubricating oil not containing the at least one boron-containing compound and the at least one overbased calcium detergent.

2. The method of clause 1 wherein the at least one overbased calcium detergent is selected from the group consisting of calcium alkyl salicylate, calcium alkyl sulfonate, calcium alkyl phenate and combinations thereof.

3. The method of clauses 1-2 wherein the minor components further comprise at least one zinc-containing compound or at least one antiwear agent, and wherein said at least one antiwear agent comprises at least one zinc dialkyl dithiophosphate compound derived from a secondary alcohol.

4. The method of clauses 1-3 wherein the lubricating oil base stock comprises a Group I, Group II, Group III, Group IV, or Group V base oil.

5. The method of clauses 1-4 wherein the boron-containing compound or borated dispersant is selected from the group consisting of a borated succinimide, a borated succinate ester, a borated succinate ester amide, a borated Mannich base, and mixtures thereof; and the non-borated dispersant comprises a succinic anhydride derived succinimide or succinate ester with a coupling agent, wherein the coupling agent comprises a boron-containing compound.

6. The method of clauses 1-5 wherein boron is provided to the lubricating oil by a mixture of an organic or inorganic boron-containing compound and a borated succinimide, a borated succinate ester, a borated succinate ester amide, a Mannich base ester, or mixtures thereof; wherein the borated succinimide is a mono succinimide, bis-succinimide, or a mixture thereof.

7. The method of clauses 1-6 wherein the boron-containing compound and borated dispersant concentration ranges from 0.1 to 20 weight percent, based on the total weight of the lubricating oil.

8. The method of clause 2 wherein (i) calcium contributed by the at least one overbased calcium detergent is present in the lubricating oil in an amount from 500 ppm to 5000 ppm; (ii) total base number (TBN), as measured by ASTM D2896, contributed by the detergent ranges from 2 mg KOH/g to 17 mg KOH/g; or (iii) sulfated ash contributed by the detergent ranges from 0.4 to 1.7 wt %.

9. The method of clauses 1-8 wherein the at least one overbased calcium detergent concentration ranges from 1.0 to 6.0 weight percent, based on the total weight of the lubricating oil.

10. The method of clause 3 wherein the zinc-containing compound is selected from the group consisting of zinc carboxylate, zinc sulfonate, zinc acetate, zinc napthenate, zinc alkenyl succinate, zinc acid phosphate salt, zinc phenate, and zinc salicylate.

11. The method of clause 3 wherein the zinc dialkyl dithiophosphate compound is represented by the formula $$Zn[SP(S)(OR^1)(OR^2)]_2$$

wherein $R^1$ and $R^2$ are independently primary or secondary $C_1$ to $C_8$ alkyl groups, provided at least one of $R^1$ and $R^2$ is a secondary $C_1$ to $C_8$ alkyl group.

12. The method of clause 3 wherein (i) zinc content contributed by the zinc-containing compound or antiwear agent in the lubricating oil ranges from 500 ppm to 2000 ppm; (ii) phosphorus content contributed by the zinc-containing compound or antiwear agent compound in the lubricating oil ranges from 400 ppm to 2000 ppm; (iii) zinc to phosphorus ratio in the lubricating oil ranges from 1.0 to 2.0; or (iv) the ratio of total metals provided by the detergent to total metals provided by the zinc-containing compound and antiwear agent is 0.8 to 4.8.

13. The method of clause 3 wherein the zinc-containing compound or antiwear agent concentration ranges from 0.5 to 5.0 weight percent, based on the total weight of the lubricating oil.

14. The method of clauses 1-13 wherein the lubricating oil further comprises one or more of a viscosity index improver, antioxidant, pour point depressant, corrosion inhibitor, metal deactivator, seal compatibility additive, anti-foam agent, inhibitor, anti-rust additive, and friction modifier.

15. The method of clauses 1-14 wherein the lubricating oil is used as a passenger vehicle engine oil (PVEO) or a natural gas engine oil.

16. The method of clauses 1-15 wherein the boron to nitrogen ratio for the at least one boron-containing compound ranges from 0.05 to 0.2.

17. The method of clauses 1-16 wherein the boron to nitrogen ratio is zero and wherein the nitrogen level provided by the at least one borated dispersant or the non-borated dispersant is less than 700 ppm.

18. The method of clause 17 wherein the non-borated dispersant is a PIBSA/PAM dispersant capped with ethylene carbonate.

19. A. method for preventing or reducing low speed pre-ignition in a spark ignited internal combustion engine lubricated with a lubricating oil comprising the steps of:

lubricating a spark ignited internal combustion engine with a lubricating oil comprising at least one lubricating oil base stock at from 70 to 85 wt. % based on the total weight of the lubricating oil; and at least one dispersant at a loading to contribute from 30 to 1500 ppm of boron to the oil, wherein said at least one dispersant comprises at least one borated dispersant, or a mixture of a boron-containing compound and a non-borated dispersant, wherein the boron to nitrogen ratio for the at least one dispersant is less than or equal to about 0.3 and at least one overbased calcium detergent at 1.0 to 6.0 wt. % based on the total weight of the lubricating oil with the proviso that the lubricating oil is free of elemental magnesium, and measuring the deposit control of the lubricating oil and the low speed pre-ignition of the spark ignited internal combustion engine lubricated with the lubricating oil, wherein the spark ignited internal combustion engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in a spark ignited internal combustion engine using a lubricating oil that does not comprise the at least one borated dispersant, or a mixture of a boron-containing compound and a non-borated dispersant and the at least one overbased calcium detergent, and wherein the deposit control is maintained or improved (TEOST 33C total deposits less than or equal to 34 mg) as compared to deposit control achieved using a lubricating oil not containing the at least one borated dispersant, or a mixture of a boron-containing compound and a non-borated dispersant and the at least one overbased calcium detergent.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A method for preventing or reducing low speed pre-ignition in a spark ignited internal combustion engine lubricated with a lubricating oil while maintaining or improving deposit control comprising the steps of:

lubricating a spark ignited internal combustion engine with a lubricating oil comprising a lubricating oil base stock at from about 70.1 to 78.1 wt. % of the oil, wherein the base stock is a blend of a Group III and a Group IV base oil and about 5 wt. % of a Group V base oil; and at least one boron-containing compound, at least one overbased calcium detergent and other lubricating oil additives, as minor components;

wherein said at least one boron-containing compound comprises a mixture of at least one borated dispersant comprising a borated polyisobutylene succinic anhydride/polyamine (PIBSA/PAM) at from about 0.6 to 2.8 wt. % of the oil and a non-borated dispersant comprising a PIBSA/PAM capped with ethylene carbonate or a polyisobutenyl bis-succinimide at from about 3.3 to 9.0 wt. % of the oil, wherein the at least one boron-containing compound contributes from about 50 to 240 ppm of boron to the oil, wherein the boron to nitrogen ratio for the at least one boron-containing compound is greater than or equal to about 0.05 to less than or equal to about 0.242 with the proviso that the lubricating oil is essentially free of elemental magnesium and essentially free of magnesium based detergent;

wherein the at least one overbased calcium detergent comprises one or more calcium salicylate detergent having a Total Base Number (TBN) from about 70 to 200 at from about 5.0 to 5.5 wt. % of the oil;

wherein the other lubricating oil additives comprise from about 8.6 to 14.8 wt. % of the oil, and measuring the deposit control of the lubricating oil via the TEOST 33C (ASTM D6335) and the low speed pre-ignition (LSPI) of the spark ignited internal combustion engine lubricated with the lubricating oil via the Ford LSPI test;

wherein the spark ignited internal combustion engine exhibits Ford LSPI test counts of less than or equal to 21, and wherein the deposit control is maintained or improved (TEOST 33C total deposits less than or equal to 34 mg) as compared to deposit control achieved using a lubricating oil not containing the at least one boron-containing compound and the at least one overbased calcium detergent.

2. The method of claim 1 wherein the minor components further comprise at least one zinc-containing compound or at least one antiwear agent, and wherein said at least one antiwear agent comprises at least one zinc dialkyl dithiophosphate compound derived from a secondary alcohol.

3. The method of claim 1 wherein the Group V base oil comprises an ester base oil having a kinematic viscosity at 100° C. of 2 cSt to 8 cSt, the Group III base oil comprises a GTL base oil having a kinematic viscosity at 100° C. of 2 cSt to 8 cSt, and the Group IV base oil comprises a polyalphaolefin base oil having a kinematic viscosity at 100° C. of 2 cSt to 8 cSt.

4. The method of claim 2 wherein the ratio of total zinc from the zinc-containing compound and antiwear agent plus total calcium from the detergent divided by the total boron from the boron-containing compound and borated dispersant, in the lubricating oil, is 9.2 to 45.

5. The method of claim 1 wherein (i) calcium contributed by the at least one overbased calcium detergent is present in the lubricating oil in an amount from 500 ppm to 5000 ppm; (ii) total base number (TBN), as measured by ASTM D2896, contributed by the detergent ranges from 2 mg KOH/g to 17 mg KOH/g; or (iii) sulfated ash contributed by the detergent ranges from 0.4 to 1.7 wt %.

6. The method of claim 2 wherein the zinc-containing compound is selected from the group consisting of zinc carboxylate, zinc sulfonate, zinc acetate, zinc napthenate, zinc alkenyl succinate, zinc acid phosphate salt, zinc phenate, and zinc salicylate.

7. The method of claim 2 wherein the zinc dialkyl dithiophosphate compound is represented by the formula $$Zn[SP(S)(OR^1)(OR^2)]_2$$

wherein $R^1$ and $R^2$ are independently primary or secondary $C_1$ to $C_8$ alkyl groups, provided at least one of $R^1$ and $R^2$ is a secondary $C_1$ to $C_8$ alkyl group.

8. The method of claim 7 wherein the primary or secondary $C_1$ to $C_8$ alkyl groups of the zinc dialkyl dithiophosphate compound are derived from an alcohol selected from the group consisting of: 2-propanol (i-C3), 1-butanol (n-C4), 1-isobutanol (1-i-C4), 2-butanol (2-C4), 1-pentanol (primary C-5), 3-methyl-1-butanol (primary C-5), 2-pentanol (C5), 3-pentanol (C5), 3-methyl-2-butanol (C5), 1-hexanol (primary C6), 4-methyl-1-pentanol (primary C6), 4-methyl-2-pentanol (C6), and 2-ethyl-1-hexanol (primary C8), and mixtures thereof.

9. The method of claim 7 wherein the zinc dialkyl dithiophosphate compound is derived at least in part from (i) a $C_3$ to $C_8$ secondary alcohol, or a mixture thereof; or (ii) a mixture of a $C_1$ to $C_8$ primary alcohol and a $C_1$ to $C_8$ secondary alcohol.

10. The method of claim 2 wherein (i) zinc content contributed by the zinc-containing compound or antiwear agent in the lubricating oil ranges from 500 ppm to 2000 ppm; (ii) phosphorus content contributed by the zinc-containing compound or antiwear agent compound in the lubricating oil ranges from 400 ppm to 2000 ppm; (iii) zinc to phosphorus ratio in the lubricating oil ranges from 1.0 to 2.0; or (iv) the ratio of total metals provided by the detergent to total metals provided by the zinc-containing compound and antiwear agent is 0.8 to 4.8.

11. The method of claim 2 wherein the zinc-containing compound or antiwear agent concentration ranges from 0.5 to 5.0 weight percent, based on the total weight of the lubricating oil.

12. The method of claim 1 wherein the other lubricating oil additives are selected from the group consisting of a viscosity index improver, antioxidant, pour point depressant, corrosion inhibitor, metal deactivator, seal compatibility additive, anti-foam agent, inhibitor, anti-rust additive, friction modifier and combinations thereof.

13. The method of claim 1 wherein the lubricating oil is used as a passenger vehicle engine oil (PVEO) or a natural gas engine oil.

14. The method of claim 1 wherein the boron to nitrogen ratio for the at least one boron-containing compound ranges from 0.05 to 0.2.

15. The method of claim 1 wherein the TEOST 33C total deposits are less than or equal to 24 mg.

16. A method for preventing or reducing low speed pre-ignition in a spark ignited internal combustion engine lubricated with a lubricating oil comprising the steps of:

lubricating a spark ignited internal combustion engine with a lubricating oil comprising at least one lubricating oil base stock at from 70 to 78.1 wt. % based on the total weight of the lubricating oil, wherein the base stock is a blend of a Group III and a Group IV base oil and about 5 wt. % of a Group V base oil; and at least one dispersant at a loading to contribute from about 50 to 240 ppm of boron to the oil, wherein said at least one dispersant comprises a mixture of at least one borated dispersant comprising a borated polyisobutylene succinic anhydride/polyamine (PIBSA/PAM) at from about 0.6 to 2.8 wt. % of the oil and a non-borated dispersant comprising a PIBSA/PAM capped with ethylene carbonate or a polyisobutenyl bis-succinimide at from about 3.3 to 9.0 wt. % of the oil, wherein the boron to nitrogen ratio for the at least one dispersant is greater than or equal to about 0.05 to less than or equal to about 0.242 and at least one overbased calcium detergent at about 5.0 to 5.5 wt. % based on the total weight of the lubricating oil, wherein the at least one overbased calcium detergent comprises one or more calcium salicylate detergent having a Total Base Number (TBN) from about 70 to 200 with the proviso that the lubricating oil is free of elemental magnesium and essentially free of magnesium based detergent, wherein the other lubricating oil additives comprise from about 8.6 to 14.8 wt. % of the oil, and measuring the deposit control of the lubricating oil via the TEOST 33C (ASTM D6335) and the low speed pre-ignition (LSPI) of the spark ignited internal combustion engine lubricated with the lubricating oil via the Ford LSPI test, wherein the spark ignited internal combustion engine exhibits greater than 50% reduced low speed pre-ignition, based on normalized low speed pre-ignition (LSPI) counts per 25,000 engine cycles, engine operation at 2000 revolutions per minute (RPM) and brake mean effective pressure (BMEP) at 18 bar, as compared to low speed pre-ignition performance achieved in a spark ignited internal combustion engine using a lubricating oil that does not comprise the at least one borated dispersant, or a mixture of a boron-containing compound and a non-borated dispersant and the at least one overbased calcium detergent, and wherein the spark ignited internal combustion engine exhibits Ford LSPI test counts of less than or equal to 21, and wherein the deposit control is maintained or improved (TEOST 33C total deposits less than or equal to 34 mg) as compared to deposit control achieved using a lubricating oil not containing the at least one borated dispersant, or a mixture of a boron-containing compound and a non-borated dispersant and the at least one overbased calcium detergent.

17. The method of claim 16 wherein the oil comprises SAE 0W-X or 5W-X wherein X is selected from the group consisting of 8, 12, 16, 20, 30, and 40.

18. The method of claim 16 wherein the at least one lubricating oil base stock has a kinematic viscosity ranging from 3.5 cSt to 6.0 cSt at 100 C.

19. The method of claim 16 wherein the oil has a TBN of 4 to 10 and exhibits substantial elimination of LSPI.

20. The method of claim 16 wherein the oil has a TBN of 10 to 20 and exhibits a LSPI reduction of at least 50%.

21. The method of claim 16 wherein the oil includes an ash level of from 0.2 to 1.0 wt. % and exhibits a substantial elimination of LSPI.

22. The method of claim 16 wherein the oil includes an ash level of from 1.0 to 2.0 wt. % and exhibits a LSPI reduction of at least 50%.

23. The method of claim 16 wherein the boron to nitrogen ratio for the at least one boron-containing compound ranges from 0.05 to 0.2.

24. The method of claim 16 wherein the TEOST 33C total deposits are less than or equal to 24 mg.

25. The method of claim 16 wherein the Group V base oil comprises an ester base oil having a kinematic viscosity at 100° C. of 2 cSt to 8 cSt, the Group III base oil comprises a GTL base oil having a kinematic viscosity at 100° C. of 2 cSt to 8 cSt, and the Group IV base oil comprises a polyalphaolefin base oil having a kinematic viscosity at 100° C. of 2 cSt to 8 cSt.

26. The method of claim 16 wherein the lubricating oil further comprises one or more of an antiwear agent, viscosity index improver, antioxidant, pour point depressant, corrosion inhibitor, metal deactivator, seal compatibility additive, anti-foam agent, inhibitor, anti-rust additive, and friction modifier.

27. The method of claim 16 wherein the lubricating oil is used as a passenger vehicle engine oil (PVEO) or a natural gas engine oil.

* * * * *